US005957534A

United States Patent [19]

Wilkerson et al.

[11] Patent Number: 5,957,534

[45] Date of Patent: Sep. 28, 1999

[54] CHAIR

[75] Inventors: Larry A. Wilkerson, Kent City; Richard N. Roslund, Jr., Ottawa City, both of Mich.

[73] Assignee: Haworth, Inc., Holland, Mich.

[21] Appl. No.: 08/850,534

[22] Filed: May 2, 1997

Related U.S. Application Data

[63] Continuation of application No. 08/702,120, Aug. 23, 1996, abandoned, which is a continuation of application No. 08/258,020, Jun. 10, 1994, abandoned.

[51] Int. Cl.[6] ..... A47C 1/02

[52] U.S. Cl. ..... 297/316; 297/301.1; 297/452.12; 297/452.14

[58] Field of Search ..... 297/301.1, 386, 297/292, 301.3, 301.4, 301.7, 303.3, 303.4, 452.12, 452.14, 452.65, 440.15, 300.8, 302.7

[56] References Cited

U.S. PATENT DOCUMENTS

| | | | |
|---|---|---|---|
| 3,669,496 | 6/1972 | Chisholm . | |
| 3,669,499 | 6/1972 | Semplonius . | |
| 3,672,721 | 6/1972 | Williams . | |
| 3,713,697 | 1/1973 | Koepke . | |
| 3,841,704 | 10/1974 | Platner et al. . | |
| 4,123,105 | 10/1978 | Frey et al. . | |
| 4,314,728 | 2/1982 | Faiks . | |
| 4,375,301 | 3/1983 | Pergler . | |
| 4,390,206 | 6/1983 | Falks . | |
| 4,418,958 | 12/1983 | Watkin . | |
| 4,438,898 | 3/1984 | Knoblauch . | |
| 4,451,085 | 5/1984 | Franck et al. | 297/285 |
| 4,498,702 | 2/1985 | Raftery . | |
| 4,544,205 | 10/1985 | Molnar | 297/452.14 |
| 4,561,693 | 12/1985 | Brownlie et al. . | |
| 4,685,733 | 8/1987 | Machate et al. | 297/284 |
| 4,709,894 | 12/1987 | Knoblock . | |
| 4,720,142 | 1/1988 | Holdredge et al. . | |
| 4,744,603 | 5/1988 | Knoblock . | |
| 4,776,633 | 10/1988 | Knoblock . | |
| 4,779,925 | 10/1988 | Heinzel . | |
| 4,790,598 | 12/1988 | Locher | 297/325 |
| 4,804,227 | 2/1989 | Hansen | 297/301 |
| 4,892,354 | 1/1990 | Estkowski et al. . | |
| 4,892,356 | 1/1990 | Pittman . | |
| 5,033,791 | 7/1991 | Locher | 297/302 |
| 5,042,877 | 8/1991 | Yokota . | |
| 5,050,931 | 9/1991 | Knoblock . | |
| 5,102,196 | 4/1992 | Kaneda . | |
| 5,160,184 | 11/1992 | Falks . | |
| 5,318,346 | 6/1994 | Roossien . | |
| 5,333,934 | 8/1994 | Knoblock . | |
| 5,352,022 | 10/1994 | Knoblock . | |
| 5,425,566 | 6/1995 | Buchacz . | |
| 5,538,326 | 7/1996 | Lorbiecki | 297/452 |
| 5,540,481 | 7/1996 | Roossien et al. | 297/300.4 |

FOREIGN PATENT DOCUMENTS

| | | |
|---|---|---|
| 75 00 152 | 4/1975 | Germany . |
| 75 38 910 | 4/1976 | Germany . |
| 4216358A1 | 11/1992 | Germany . |

OTHER PUBLICATIONS

Figures 1–10, drawings of prior art chair (8 pages).
Photos A–G, photographs of prior art chair (7 pages).
Voko brochure, Physio Class, May 9, 1987 (6 pages).

*Primary Examiner*—Laurie K. Cranmer
*Attorney, Agent, or Firm*—Flynn, Thiel, Boutell & Tanis, P.C.

[57] ABSTRACT

An office-type chair which provides for synchronous differential tilting of the seat and back assemblies, with the seat assembly being constructed such that the front lip thereof does not significantly lift upon rearward tilting. The chair incorporates a tilt control mechanism formed by a control body which secures to the upper end of the chair pedestal and an upright which pivotally connects to the control body about an axis disposed forwardly of the pedestal. A pivot assembly connects the upright and control body together.

33 Claims, 20 Drawing Sheets

11
13
14
10
14
12
16
15

FIG. 10
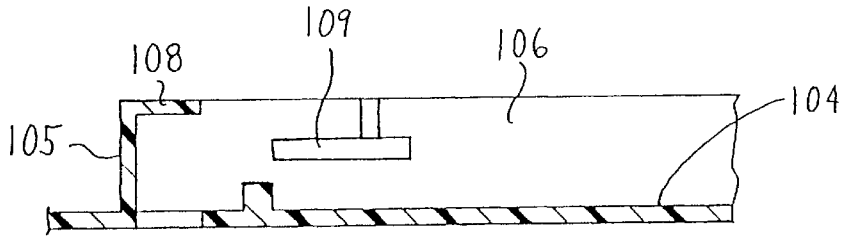
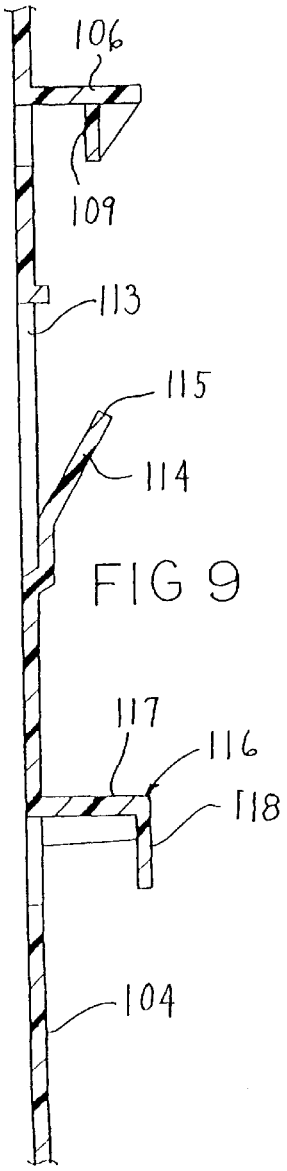
FIG 9
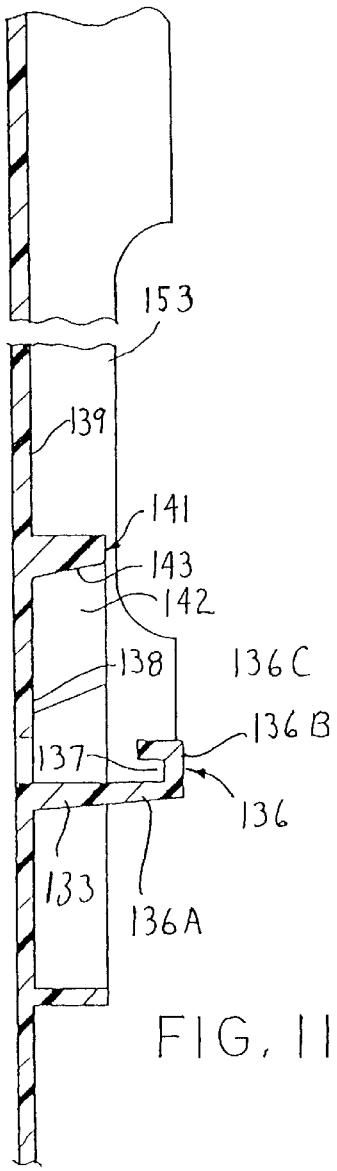
FIG. 11
FIG 12
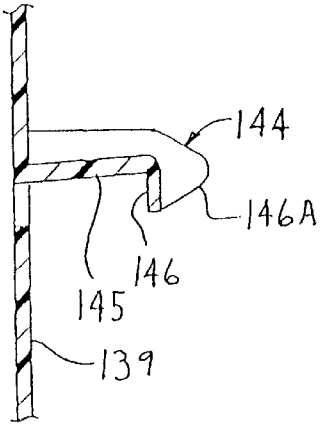

CHAIR

This application is a continuation of U.S. Ser. No. 08/702,120, filed Aug. 23, 1996, now abandoned which is a continuation of U.S. Ser. No. 08/258,020, filed Jun. 10, 1994, now abandoned.

FIELD OF THE INVENTION

This invention relates to an office-type chair having improved structural and functional characteristics so as to permit synchronous differential tilting of the seat and back assemblies.

BACKGROUND OF THE INVENTION

Office chairs have been developed which permit the back assembly to be tilted synchronously with the seat assembly but at a greater rate so that the back assembly tilts relative to the seat assembly as the latter tilts relative to the chair base. Such chairs also effectively permit tilting of the seat about an axis located adjacent the front edge thereof so as to prevent undesired lifting of the seat front edge when the occupant tilts the chair rearwardly. Nevertheless, most of the known chairs have accomplished these objectives only by use of complex structures and functional relationships which have required an undesirably large number of parts and have accordingly increased the overall complexity of assembling the chair. Such chairs hence have been more costly than desired.

Accordingly, it is an object of this invention to provide an improved chair which provides for synchronous differential tilting of the seat and back assemblies, with the seat assembly being constructed such that the front lip thereof does not significantly raise or lift upwardly upon rearward tilting, which improved chair is of simplified construction and assembly so as to overcome disadvantages of the type associated with prior chairs of this general type.

More specifically, according to one aspect of the invention, the improved chair, as aforesaid, incorporates a tilt control mechanism formed by a control body which secures to the upper end of the chair pedestal and an upright which pivotally connects to the control body about an axis disposed forwardly of the pedestal, with an improved pivot assembly being provided for connecting the upright and control body together, which pivot assembly is of improved structural simplicity and provides simplified assembly.

A further aspect of the invention is an improved chair, as aforesaid, which incorporates a one-piece molded chair shell which mounts to the control mechanism and defines both the seat and back of the chair, with the shell being secured to the control mechanism totally by substantially snap-fit latches and cooperating stops which are formed directly on and coact directly between the shell and the control mechanism, whereby the securement of the shell to the control mechanism is free of separate fasteners, thereby simplifying the overall assembly of the shell to the control mechanism.

A still further aspect of the invention is an improved chair having side arms which connect between the seat and back adjacent opposite sides of the chair, the arms at their lower front ends having hub portions which are structurally supported on outwardly projecting cantilevered ends of a main support or pivot shaft, with the chair arms being fixedly locked to an internal seat structure by a relatively-rotatable cam locking arrangement so that assembly of the front ends of the arms to the seat assembly is greatly simplified.

Another aspect of the invention is an improved chair, as aforesaid, having an improved tilt lock mechanism which cooperates between the control body and the upright so as to permit the chair to be locked either in a normal upright position or in a rearwardly tilted position, which tilt lock mechanism is of relatively simple and inexpensive construction, and is disposed within a minimal space as provided rearwardly of the control body.

Still another aspect of the invention is an improved chair having an airlift cylinder associated with the pedestal for adjusting the height of the seat assembly, and particularly an improved release mechanism for controlling activation of the airlift cylinder, which release mechanism is of structural simplicity in terms of minimal number of parts so as to reduce assembly time and cost, and which mechanism additionally permits activation of the airlift cylinder in response to an activating lever being manually displaced either upwardly or downwardly from its normal locked position.

Other objects and purposes will be apparent to persons familiar with structures similar to the present invention upon reading the following specification and inspecting the accompanying drawings.

BRIEF DESCRIPTION OF THE DRAWINGS

FIGS. 9 and 10 are enlarged, fragmentary sectional views take respectively along lines 9—9 and 10—10 in FIG. 7.

FIGS. 11 and 12 are enlarged, fragmentary sectional views taken respectively along lines 11—11 and 12—12 in FIG. 8.

Figure 1:
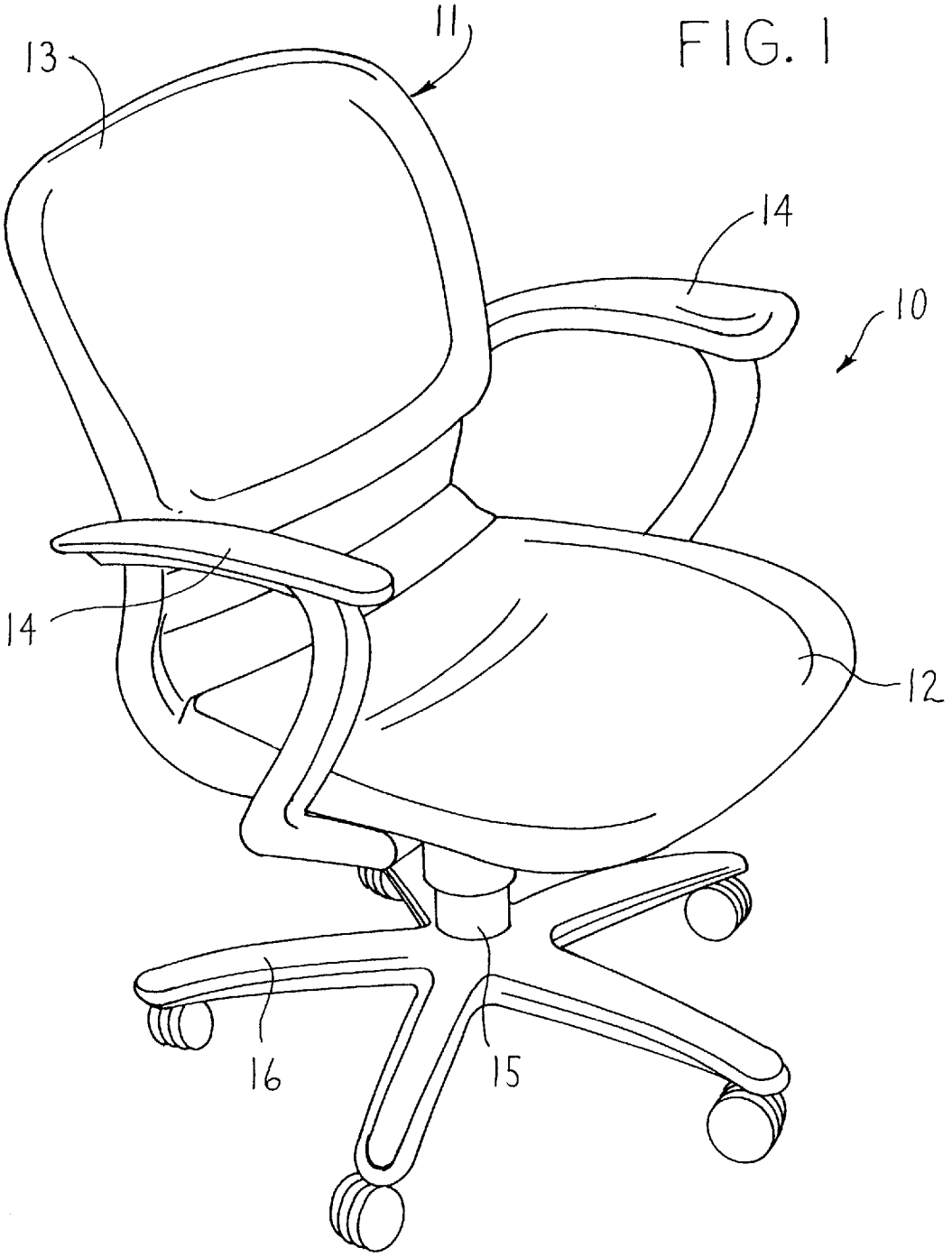
FIG. 1 is a perspective view of a chair according to the pesent invention.

Certain terminology will be used in the following description for convenience in reference only, and will not be limiting. For example, the words "upwardly", "downwardly", "rightwardly" and "leftwardly" will refer to directions in the drawings to which reference is made. These words will also be used to refer to the same directions experienced by an occupant of the chair. The words "inwardly" and "outwardly" will refer to directions toward and away from, respectively, the geometric center of the chair and designated parts thereof. Said terminology will include the words specifically mentioned, derivatives thereof, and words of similar import.

DETAILED DESCRIPTION

General Description:

Referring to FIG. 1, there is illustrated a chair according to the present invention. The chair, as is generally conventional, includes a generally L-shaped seat-back assembly 11, with the basic components thereof being a seat bottom subassembly 12 and a back subassembly 13. A pair of arms 14 are disposed adjacent opposite sides of the chair and connect the seat and back subassemblies. A height-adjustable pedestal assembly 15 has the upper end thereof connected to the seat subassembly substantially at the middle thereof, and the lower end of the pedestal assembly 15 is secured to a conventional multi-leg base 16, the latter typically being supported on a plurality of casters.

Figure 3:
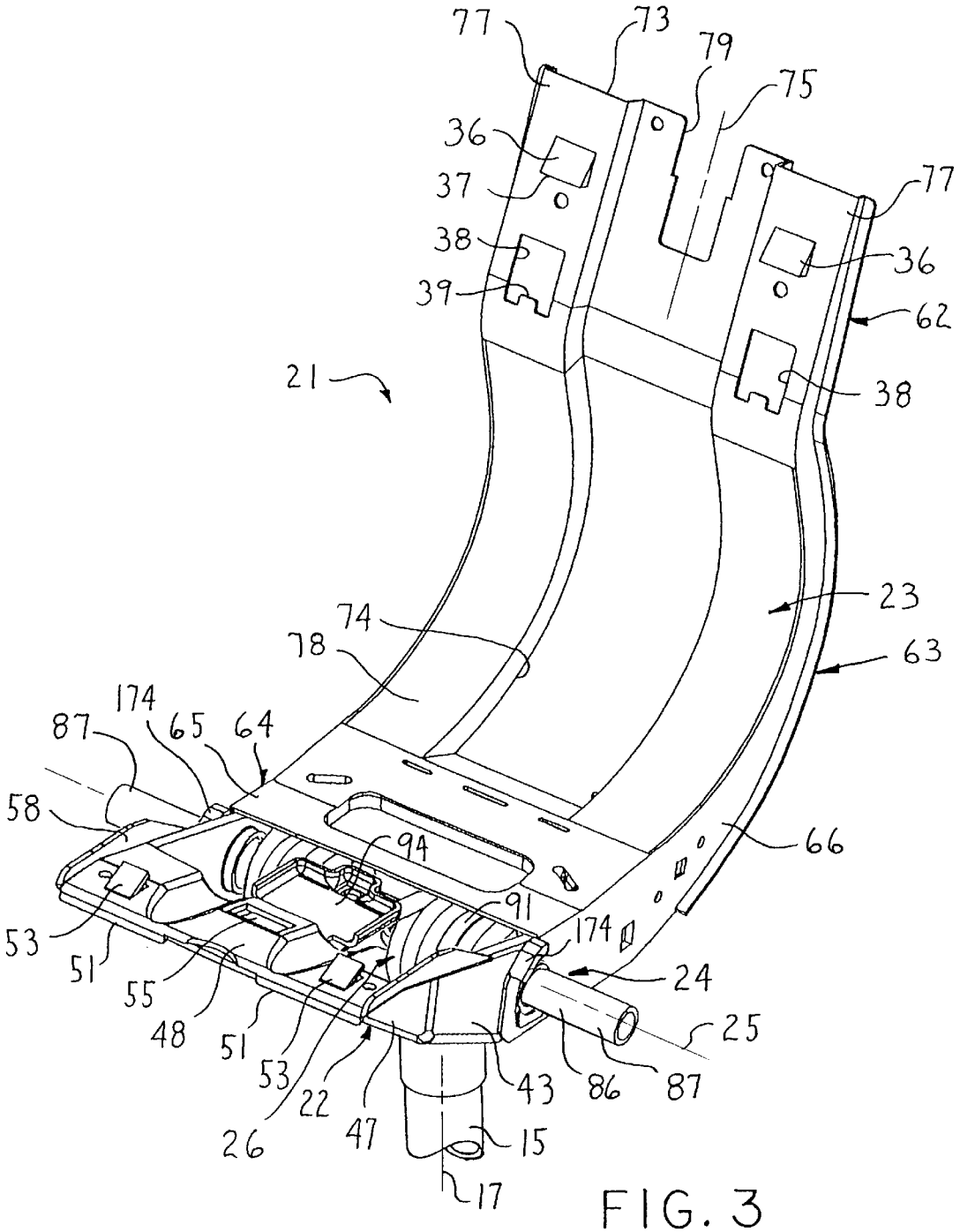
FIG. 3 is a perspective view of the chair control mechanism.
Figure 4:
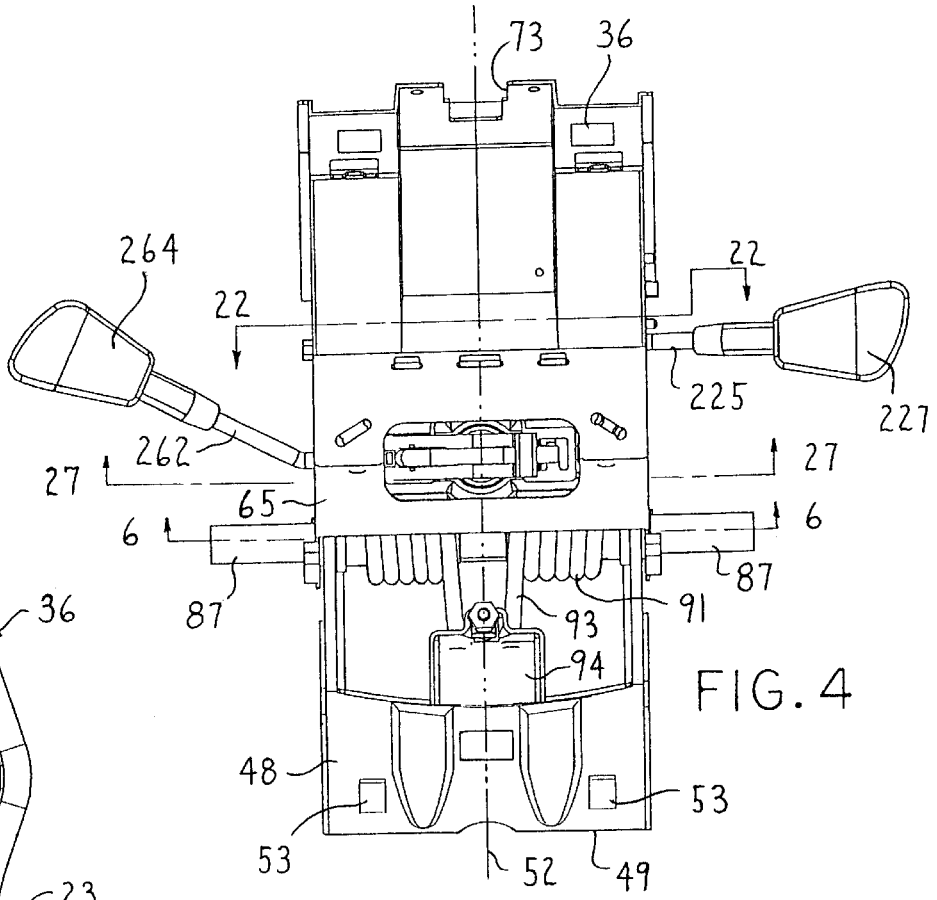
FIG. 4 is a top view of the chair control mechanism.

The seat-back assembly 11 includes therein a chair tilt control mechanism 21 (FIG. 3) which includes two primary components, namely a control body 22 which is fixed to the upper end of the pedestal 15, and an upright 23. A pivot assembly 24 pivotally connects the lower forward end of the upright 23 to the control body 22. This pivot assembly 24 defines a generally horizontally extending pivot axis 25 which extends sidewardly through the seat subassembly 12, with this pivot axis 25 being positioned forwardly from the vertical longitudinal axis 17 of the pedestal 15. A biasing assembly 26 coacts between the control body 22 and the upright 23 so as to normally resiliently urge the upright 23 into an upright position as illustrated by FIG. 3.

Figure 2:
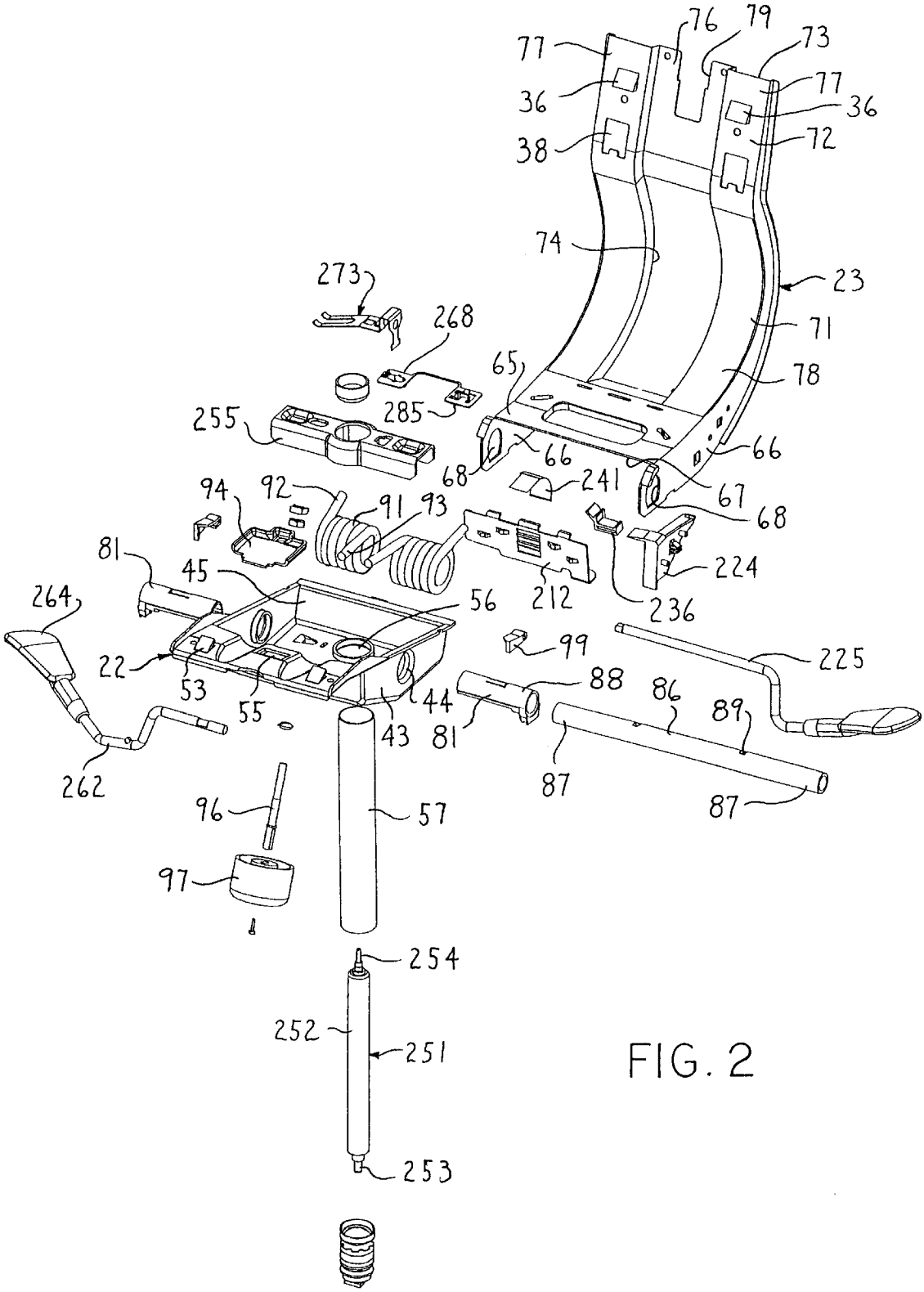
FIG. 2 is an exploded perspective view of the chair control mechanism.
Figure 2A:
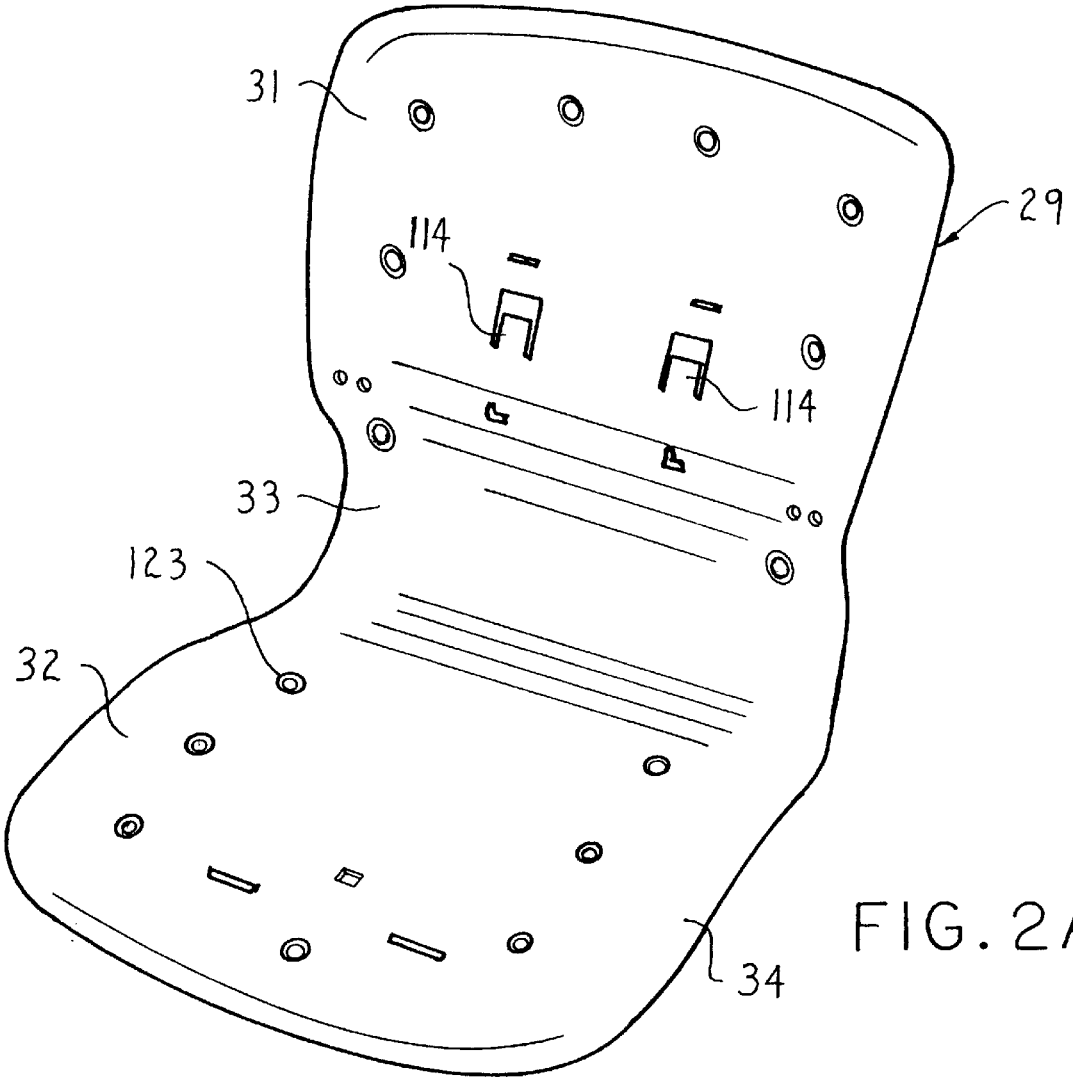
FIG. 2A is a perspective view of the shell mounted on the control mechanism.
Figure 5:
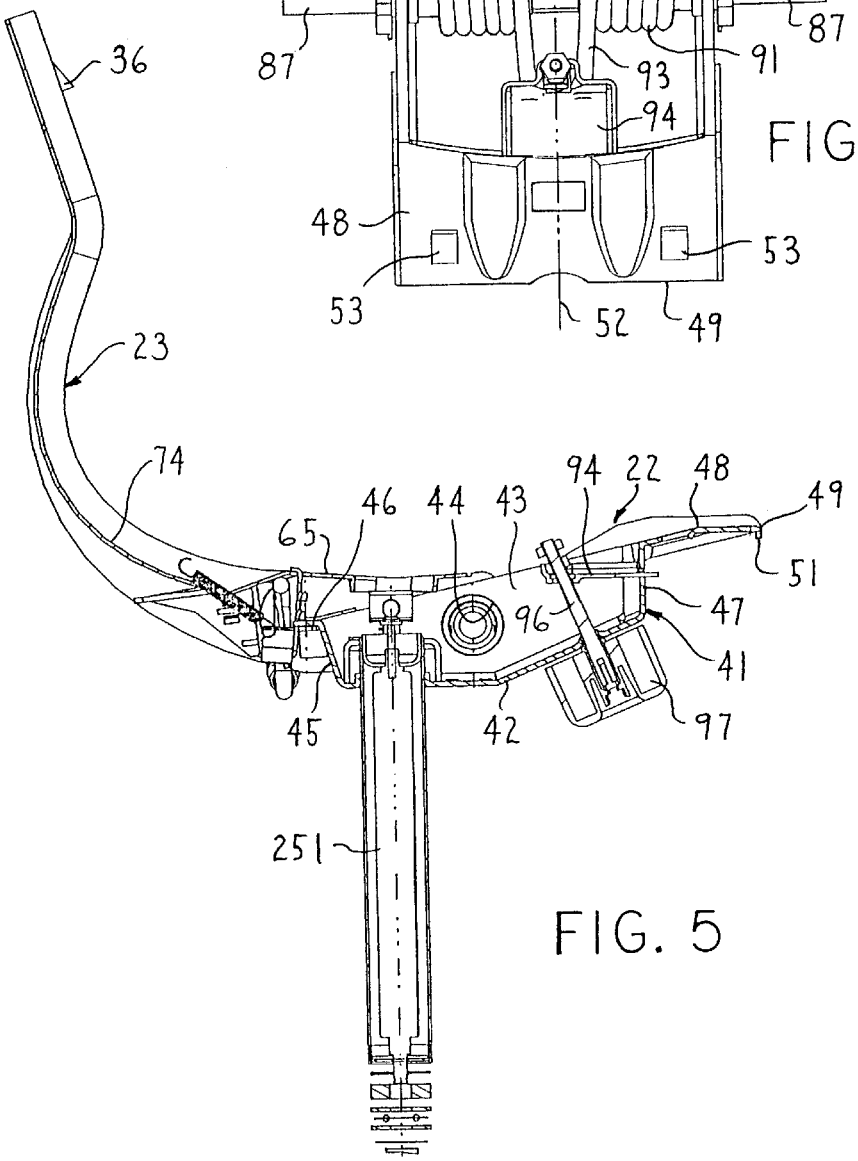
FIG. 5 is a side elevational view, partially in section, showing the chair control mechanism mounted on the support pedestal.

The chair 10 of the present invention also includes a one-piece chair shell 29 (FIGS. 2A and 5) which mounts on the control mechanism 21 and is covered by a suitable cushion (not shown) in a conventional manner so as to permit support of a chair occupant. The chair shell 29 has a back part 31 which is disposed in front of and is fixedly secured to the upper portion of the upright 23, and also includes a seat part 32 which is positioned on top of and has the front portion thereof fixedly secured to the control body 22. The back and seat parts 31 and 32 are in turn joined together by an intermediate arcuate part 33 which is of a generally concave configuration so as to open outwardly or forwardly of the chair. This part 33 is readily flexible so as to permit the back part 31 of the chair shell to hingedly flex or pivot relative to the seat part 32.

The chair shell 29 is formed, preferably by being molded of a plastics material, as a one-piece member, the main body of which throughout the entirety of the shell is of a relatively thin semi-rigid sheetlike structure 34 having a thickness which is relatively uniform throughout a majority of the shell. The plastic used for molding the chair shell 29 enables the sheetlike body 34 to have at least limited flexibility or resiliency. The back and under sides of the seat and back parts 31 and 32, respectively, are provided with stiffening structures molded thereon, as explained hereinafter, to control the shape of the shell.

The one-piece chair shell 29 is preferably molded in a generally flat or open condition, with the shell then being arcuately deflected about the intermediate part 33 so as to assume a generally L-shaped configuration when the shell in mounted onto the control mechanism 21.

Tilt Control Mechanism:

Considering now the details of the control mechanism 21 and specifically the control body 22, it includes a one-piece cuplike housing 41 which is of a generally shallow and upwardly-opening configuration. This housing 41 includes a bottom wall 42 having a pair of generally parallel side walls 43 projecting upwardly from opposite sides thereof. These side walls have horizontally aligned openings 44 formed therethrough for accommodating the pivot assembly 24. A rear wall 45 projects upwardly from the bottom wall and terminates in a top flange 46 which projects rearwardly. A front wall 47 projects upwardly from the bottom wall and, at its upper edge, is bent outwardly and projects forwardly of the control body over a significant extent so as to define a lip part 48 which terminates generally in a front edge 49. This lip part 48 is disposed generally flush with the upper edge of the cup-shaped housing 41 and is formed integrally in one piece therewith.

The lip part 48 has a width which generally corresponds to the width of the cup-shaped housing 41 and, at the front edge 49 thereof, is provided with a pair of front securing flanges 51 which are disposed adjacent opposite ends of the front edge and are cantilevered downwardly through a short vertical extent. These front securing flanges 51 are disposed uniformly on opposite sides of a centerline 52 which extends longitudinally of the control body. A further pair of stop flanges 53 are also formed in the lip part 48 so as to be uniformly disposed on opposite sides of the centerline 52, which stop flanges 53 are disposed rearwardly a small distance from the front edge 49. The stop flanges 53 are formed by being stamped or deformed upwardly from the plate material defining the control body, whereby each stop flange 53 slopes upwardly as it projects rearwardly and terminates in a free edge or shoulder which is spaced above the upper surface of the lip part.

Lip part 49 also has a generally rectangular opening or window 55 formed vertically therethrough for accommodating a retainer or latch associated with the chair shell, as explained hereinafter. This opening 55 is located generally on the longitudinal centerline 52 and is disposed somewhat rearwardly from the stop flanges 53 but forwardly from the front wall 47 of the cup-shaped housing.

The control body 22 also has an opening 56 formed vertically through the bottom wall 42 thereof, which opening is disposed generally on the longitudinal centerline 52 but is spaced rearwardly from the axis 25 of the aligned openings 44 associated with the side walls 43. A vertically elongate support tube 57 is coaxially aligned with the opening 56 and is fixedly secured to and projects downwardly from the bottom wall 42 so as to define an outer guide tube which is part of the height-adjustable pedestal assembly 15. The control body 22 also has stiffening flanges 58 which are provided adjacent opposite sides of the lip part 48 and which project vertically upwardly through a small vertical extent. These stiffening flanges 58 also project rearwardly partway along opposite sides of the cup-shaped housing 41.

Considering now the construction of the upright 23, it is formed generally as a one-piece L-shaped weldment and includes a generally straight upper part 62 which at its lower end joins to an arcuate part 63, which in turn joins to a generally flat base part 64 which projects forwardly through a short extent. The arcuate part 63 is of a forwardly-opening concave configuration formed on a generally large radius, with the concave part in the illustrated embodiment extending through an angle slightly in excess of 90°. The overall one-piece weldment has a generally L-shaped configuration when viewed from the side, whereby the upper part 62 projects into the back subassembly 13, whereas the base part 64 projects into a rear portion of the seat subassembly 12.

The base part 64 has a generally shallow, downwardly-opening, channel-like cross section defined by a top wall 65 which at opposite edges is bent downwardly to define generally parallel side walls 66, the latter projecting downwardly and terminating in free edges. The top wall 65 terminates in a front edge 67, whereas the side walls 66 have flange or earlike portions which project forwardly in parallel relationship and which define horizontally aligned openings 68 therethrough. The channel-shaped configuration of the base part 64 is such that the side walls 66 closely exteriorly straddle the side walls 43 of the cup-shaped housing 41, with the front ears being disposed such that the openings 68 are closely adjacent and substantially coaxially aligned with the openings 44.

The channel-shaped cross section of the base part 64 is extended upwardly both through the arcuate part 63 and the upper part 62, with the depth of the channel part progressively decreasing throughout the arcuate part 63, whereby the depth of the channel-shaped cross section throughout the top part 62 is rather shallow. Similarly, the top or base wall 65 of the base part 64 continues into and defines a smoothly curved top or base wall 71 which extends throughout the arcuate part 63, and this base wall 71 in turn joins to the base or front wall 72 associated with the upper part 62. This base wall 72 terminates at a free upper edge 73 of the upright. The base walls 71 and 72 associated with the arcuate parts 62 and 63 have a strengthening channel 74 formed therein, which strengthening channel extends longitudinally along the centerline of the upright from the free upper edge 73 downwardly through the upper part 62 and thence downwardly through a majority of the arcuate part 63. This strengthening channel results in formation of a rear wall 76 which is generally parallel with but spaced downwardly or rearwardly from the respectively adjacent base wall, such as rearwardly from the front wall 72 of the top part 62. Due to the provision of the strengthening channel, the front wall 72 of the top part has a pair of sidewardly spaced front wall portions 77 which are disposed adjacent opposite sides of the upright, which front wall portions 77 project downwardly and extend similarly through a majority of the arcuate portion 63 and, adjacent the lower part of the arcuate portion where it joins to the base part, define thereon upwardly-facing slide surfaces or tracks 78.

The upper part 62 has a slot 79 formed therein, which slot 79 projects downwardly from the free upper edge 73 through a limited extent, and is defined between generally parallel side edges which substantially perpendicularly intersect the upper edge 73. The front wall portions 77 in addition have a pair of stop flanges 36 associated therewith, which flanges are spaced uniformly on opposite sides of the centerline 75 and are spaced downwardly a small distance from the free upper edge 73. Each stop flange 36 is formed generally as a ramplike element which is deformed outwardly from the front surface of the respective wall portion 77, with this stop flange being ramped or sloped outwardly away from the front surface as the flange 36 projects downwardly so as to terminate in a free edge or shoulder 37. Each wall portion 77 also has a generally rectangular opening or window 38 formed therethrough, which window is disposed downwardly from the stop flange associated with the respective wall portion 77. The openings or windows 38 as associated with the two wall portions 77 are also disposed uniformly on opposite sides of the centerline 75. Each opening 38 has a tongue-like projection or tab 39 projecting upwardly partway into the opening from the lower edge thereof.

Figure 6:
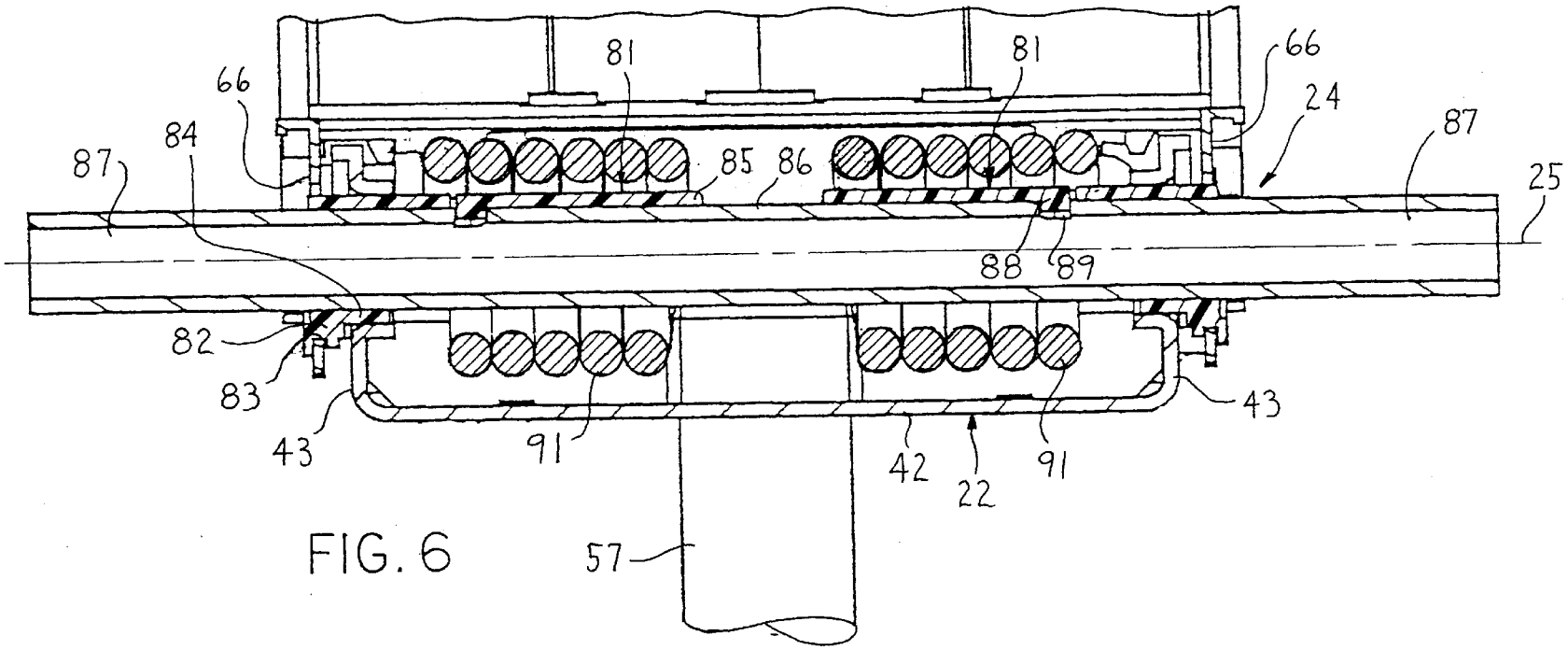
FIG. 6 is an enlarged sectional view taken substantially along line 6—6 in FIG. 4 and showing the pivot shaft arrangement.

Pivot Assembly:

The control body 22 and upright 23 are pivotally coupled together by the pivot assembly 24 which, as illustrated by FIGS. 3 and 6, includes a pair of substantially identical one-piece bearing sleeves 81 constructed of a suitable bearing material, such as a plastics material. Each bearing sleeve 81 has a radially projecting flange 82 at one end thereof, which flange on at least one side thereof has a noncircular profile so as to nonrotatably fit within the opening 68 provided in the side wall 66. This flange 82, in the lower edge thereof, is provided with a groove 83 which accommodates therein the wall defining the lower edge of the opening 68 to hence axially position the bearing 81 relative to the side wall 66.

The bearing sleeve 81, axially adjacent the flange 82, has a cylindrical bearing portion 84 which is seated within the opening 44 of the adjacent side wall 43 of the control body 22. The flange 82 and bearing portion 84 define a cylindrical opening therethrough which defines the pivot axis 25.

Bearing sleeve 81 also includes a spring bearing portion 85 which is integrally fixed to and projects axially inwardly from the cylindrical bearing portion 84. This spring bearing portion 85 could be of cylindrical configuration if desired but, in the illustrated embodiment, is approximately semi-cylindrical since this bearing portion 85 functions solely as a bearing surface for engagement with a torsion spring, described below, which spring makes contact at only one side of the bearing sleeve.

With the two bearing sleeves 81 projecting inwardly from and mounted on the opposite side walls 66 of the control, an elongate main support shaft 86 is slidably inserted into and supportingly positioned by the two bearing sleeves 81, which main shaft 86 defines the pivot axis 25. This main shaft 86 is disposed such that cylindrical end parts 87 thereof project outwardly in cantilevered fashion from opposite sides of the upright 23.

The shaft 86 is axially and nonrotatably secured relative to the bearing sleeves 81. For this purpose each bearing sleeve 81 has a detent 88 associated therewith. The detent 88 is an axially elongate cantilevered spring finger which is formed as part of the sleeve bearing, which spring finger at its free end has a projection which is resiliently snapped into a suitable opening 89 as formed through the wall of the main shaft 86.

Considering now the biasing assembly 26, same includes a pair of conventional torsion springs 91 which are positioned within the control body 22 between the side walls 43 thereof. The torsion springs are disposed generally in axially spaced relationship and surround the main shaft 86. The spring bearing portion 85 is positioned so as to maintain contact with the interior of the torsion spring. Each of the torsion springs 91 has an outwardly projecting free end or arm 92 at one end thereof which projects under and is engaged with the undersurface of the top wall 66 on the upright 23. In similar fashion, each torsion spring 91 at the other end has an outwardly projecting free end or arm 93 which projects under an attachment plate 94. This latter plate has a projecting tab at the front end thereof which projects into a horizontally-elongated slot formed in the front wall 47, whereby the attachment plate has limited vertical pivotal movement about the slot. An elongate shaft 96 is rotatably supported on the bottom wall 42 and projects downwardly therefrom and is provided with a gripping knob 97 secured thereto. This shaft projects upwardly into the interior of the control body and is suitably threadably connected to the attachment plate 94, such as by being threaded to a nut which is fixedly secured to the attachment plate. Rotation of the knob 97 and shaft 96 hence effects limited vertical pivoting of the attachment plate 94 which, due to its engagement with the arms 93 of the torsion springs 91, permits the torsion of the springs to be initially adjusted.

Due to the reaction of the torsion springs 91 between the attachment plate 94 secured to the control body 22, and the reaction of the springs against the upright 23, the upright 23 is always biased by the torsion springs toward an upright position. This upright position is defined by engagement between stops provided on the control body and upright. The side walls 66 of the upright as associated with the arcuate part 63 have stops 99 (FIG. 22) which project inwardly from the inner surface thereof directly adjacent the rear corners of the cup-shaped housing 41. This cup-shaped housing 41 of the control body 22 has bumpers 98 mounted on the upper rear corners thereof. These bumpers 98, which are normally of a plastics material, engage the stops 99 to define the upright position of the upright 23 relative to the control body 22. The torsion springs 91 normally resiliently urge the upright 23 to pivot relative to the control body 22 about the axis 25 (counterclockwise in FIG. 3) into an upright position substantially as illustrated by FIG. 3, in which position the stops 99 abut the bumpers 98. Further forward pivoting or tilting of the upright 23 beyond this upright position of FIG. 3 is not permitted.

Chair Shell:

Considering now the construction of the chair shell 29, and referring specifically to FIGS. 7–12, the back part 31 (FIG. 7) is defined between side edges 101 which smoothly merge into a top edge 102. A generally U-shaped rib pattern 103 is formed on an projects outwardly from the rear surface 104 of the back part 31. This U-shaped rib pattern 103 is oriented generally downwardly and includes generally parallel side ribs 105 which project vertically downwardly of the seat part 31, with the side ribs 105 at their upper ends being joined together by a generally horizontally-extending top rib 106. These ribs 105 and 106 define therein an open region or channel 107, the depth of which is limited by the rear surface 104.

A first pair of securing flanges 108 (FIGS. 7 and 10) are fixed to the side ribs 105 adjacent the upper ends thereof, which flanges project inwardly toward one another. These flanges 108 are cantilevered inwardly from the ribs 105, and are spaced rearwardly from the rear surface 104 so as to define a slot or clearance space therebetween which approximately corresponds to the height of the ribs 105. These securing flanges 108 in the illustrated embodiment are located directly at the upper corners of the channel 107 and are also joined to the top rib 106.

A further pair of securing flanges 109 (FIGS. 7 and 9) are joined to and project downwardly in perpendicular relationship from the top rib 106. The securing flanges 109 are also cantilevered outwardly so as to be disposed generally parallel with but spaced rearwardly from the rear surface 104 to define a confinement slot therebetween. Flanges 109, however, are joined to the top rib 106 in downwardly spaced relationship from the free edge thereof, whereby the slot defined between the flange 109 and rear surface 104 has a thickness which is significantly smaller than the thickness of the slot defined beneath the securing flanges 108.

The pair of securing flanges 108, as well as the pair of securing flanges 109, are disposed uniformly on opposite sides of a central axis 111 which extends longitudinally of the chair shell 29.

A pair of generally parallel, vertically elongated guide plates 112 project outwardly in cantilevered relation from the rear surface 104. These guide plates 112 are disposed closely adjacent to but uniformly spaced on opposite sides of the centerline 111, and are disposed downwardly a small distance from the top rib 106.

A pair of generally rectangular windows or openings 113 are formed through the sheet material defining the seat part 31, which openings are spaced downwardly from the top rib 106 and are disposed uniformly on opposite sides of the centerline 111 in close proximity to the respective side ribs 105. Each opening 113 has a resilient stop flange 114 associated therewith, which stop flange is integrally joined to the lower edge of the respective opening 113. The stop flange projects upwardly and terminates in a free edge 115. The stop flange 114 slopes outwardly away from the rear surface 104 as it projects upwardly to the free end 115.

A pair of L-shaped latches 116 (FIGS. 7 and 9) are integrally fixed to and project outwardly in cantilevered relation from the rear surface 104. Each latch 116 is disposed generally in downwardly spaced relation from the respective stop flange 114. The L-shaped latches 116 are also uniformly positioned on opposite sides of the centerline 111, and each latch includes an arm 117 which is integral with and cantilevered outwardly from the rear surface 104. This arm 117, which can be resiliently deflected, has a retainer flange 118 cantilevered downwardly therefrom in generally parallel relation to the rear surface 104.

The back part 31 of the chair shell also has a plurality of generally cylindrical retainer hubs 121 associated with the rib pattern 103 and projecting outwardly from the rear surface 104. The cylindrical hubs are disposed in spaced relationship generally along both side edges and also the top edge. These retainer hubs have an opening 122 that extends axially therethrough for communication with a respective recess 123 (FIG. 2) which is formed in the front surface of the chair shell. These hubs 121 cooperate in a conventional manner with fasteners associated with a rear cover (not shown) for permitting securement of the rear cover to the chair.

Considering now the seat part 32 of the chair shell 29, and referring to FIG. 8, this seat part again is defined generally between side edges 128 which smoothly and roundly merge into a front edge 129. A generally U-shaped rib pattern 131 is provided integrally on and projects outwardly from the rear or bottom surface 139 of the seat part 32. This U-shaped rib pattern 131 opens generally rearwardly away from the front edge 129, and includes generally parallel side ribs 132 which at their front ends are joined together by a front rib 133 extending perpendicularly therebetween. These ribs 132 and 133 cooperate to define a open region or channel 134 therebetween, which channel is bounded by the bottom surface 139. A plurality of cylindrical retainer hubs 135 are associated with the U-shaped rib pattern and extend along the side and front edges of the seat part 32. These retainer hubs 135 are formed generally similar to the hubs 121 described above, and are used in a conventional-manner to cooperate with fasteners associated with a bottom cover or pan (not shown) which encloses the bottom side of the chair seat.

A pair of generally U-shaped retaining flanges 136 (FIGS. 8 and 11) are fixedly secured to the front rib 133 adjacent the opposite ends thereof. Each U-shaped retaining flange 136 includes a first leg 136A which is a downward extension of rib 133 and, at its lower end, is joined to a leg or flange 136B which projects rearwardly in generally parallel but spaced relationship from the bottom surface 139, with this leg at its other end terminating in a further short leg 136C which projects upwardly toward the bottom surface 139. This U-shaped retaining flange 136 defines therein an elongate upwardly-opening groove 137 which extends parallel to the front rib 133, with this groove being rearwardly accessible through the region 138. The retaining flanges 136 are disposed uniformly on opposite sides of the longitudinal centerline 111.

Seat part 32 also has a pair of U-shaped stop blocks 141 (FIGS. 3 and 11) secured to and projecting outwardly from the bottom surface 139. Each stop block 141 is associated with and in fact positioned generally aligned with but spaced rearwardly from a respective one of the retaining flanges 136. Each stop block 141 defines therein a channel 142 which opens frontwardly toward the adjacent retaining flange. This channel, at its rearward end, is closed by a wall 143. The U-shaped stop blocks 141 are also symmetrically positioned on opposite sides of the centerline 111.

A generally L-shaped latch 144 (FIGS. 8 and 12) is integrally joined to and projects outwardly in cantilevered relation from the bottom surface 139. This latch is disposed generally on the longitudinal centerline 111, and is spaced somewhat rearwardly from the U-shaped stop blocks 141. The latch 144 has an elongate arm 145 which projects downwardly from the bottom surface and possesses limited resiliently. This arm 145 at its lower end is provided with a retainer flange 146 which is cantilevered toward the front edge so as to be disposed in generally parallel but downwardly spaced relationship from the bottom surface 139. This flange has a ramplike cam surface 146A formed thereon.

Also formed integrally with the seat part 32 is an elongate support rib 147 which, in cross section, projects downwardly from the bottom surface 139 and extends across the width of the channel 134 so as to have opposite ends thereof rigidly joined to the side ribs 132. This support rib 147, adjacent opposite ends thereof, is provided with bearing portions 148 which are approximately of semi-cylindrical exterior configuration so as to be slidably engageable with the slide surfaces or tracks 78 formed on the upright 23.

Figure 8:
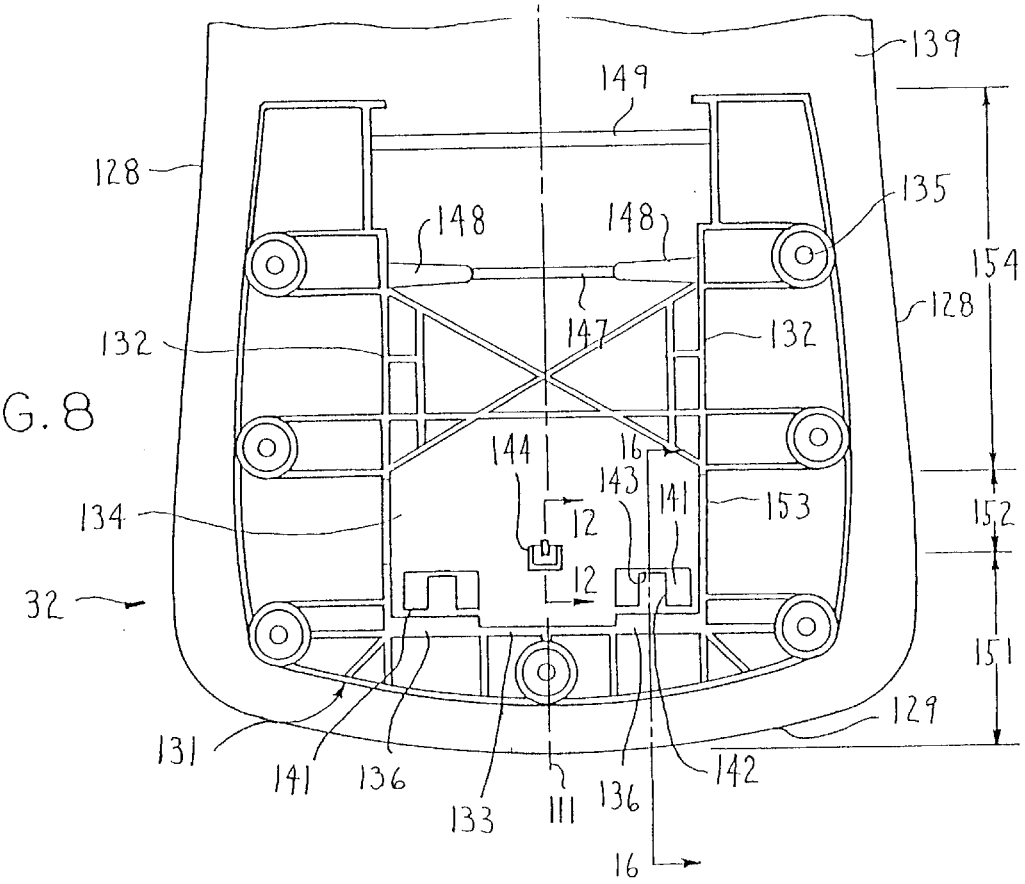
FIG. 8 is a view of the bottom side of the seat part of chair shell, which view is shown flat for convenience in illustration.
Figure 13:
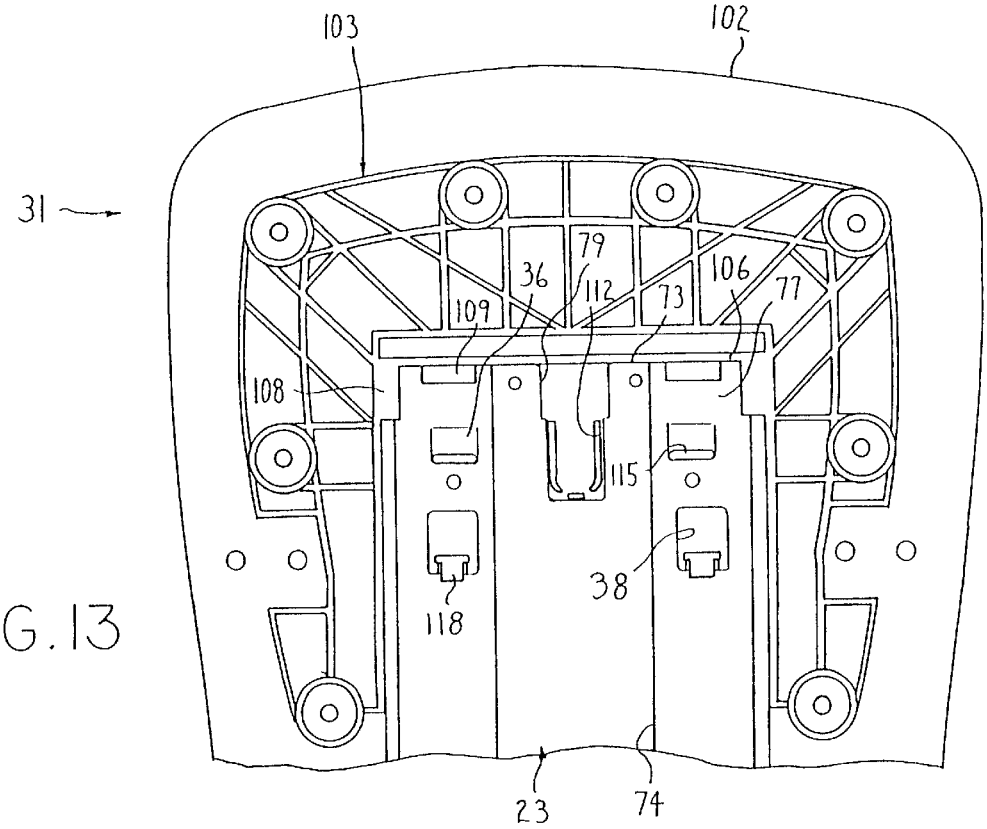
FIG. 13 is a view similar to FIG. 7 but showing the upper portion of the upright engaged with the back part of the chair shell.

As illustrated by FIG. 8, the support rib 147, which extends generally parallel with the front rib 133, is positioned forwardly a substantial distance from the rearward free ends of the U-shaped rib pattern 131. In fact, this support rib 147 is normally positioned rearwardly from the front edge 129 by a distance in the range of from about two-thirds to about three-fourths of the overall seat depth.

If necessary or desired, a secondary support rib 149 can also be formed so as to project downwardly from the bottom surface 139, with this rib extending perpendicularly between the side ribs 132. The secondary rib 149 will preferably be disposed somewhat rearwardly from the support rib 147, and will also have a rounded outer configuration, such as an approximately semi-cylindrical configuration. This secondary support rib 149 may assist in maintaining proper contour of the chair shell by also slidably contacting the slide surfaces or tracks 78 associated with the upright 23.

The seat part 32 of the chair shell 29 effectively defines different portions which, as illustrated by FIG. 8, include a lip portion 151 which projects rearwardly a small extent from the front edge 129, which lip portion includes the front or bight portion of the rib pattern 131, the retaining flanges 136, the stop blocks 141 and the L-shaped latch 144. This lip portion in turn is joined to a flexing hinge portion 152, the latter extending across the complete width of the seat part and being of rather small dimension in the front-to-back direction. This flexing hinge part 152 in turn joins to a rear seat portion 154 which projects rearwardly for connection to the arcuate shell part 33. While the flexing hinge part 152 does have ribs 153 secured to and projecting outwardly from the bottom surface 139 and extending transversely thereacross, nevertheless the ribs 153 are of lesser height than the ribs associated with the seat portions 151 and 154. Thus, the reduced height of these ribs 153, coupled with the absence of any other reinforcing structure in this flexing or hinge part 152, facilitates angular deflection of this part 152, and hence facilitates tilting or deflection of the rear seat portion 154 relative to the front lip portion 151.

As to the arcuate shell portion 33, which portion joins the back and seat parts 31 and 32 together, the rear surface of this arcuate shell part 33 is free of any outwardly protruding reinforcement ribs or the like. That is, this,arcuate shell part 33 is of generally uniform thickness throughout both the longitudinal and widthwise extend thereof. This thus permits this arcuate part 33 to readily flex, and thereby permits the back part 31 to readily angularly flex (i.e., tilt) relative to the seat part 32.

Shell/Control Securement:

The securement of the one-piece shell 29 to the control 21 is accomplished entirely by means of the retaining and securing flanges and appropriate stop flanges provided on the control and chair shell. This enables the chair shell 29 to be effectively snap locked onto the control mechanism without requiring separate fasteners such as screws or the like. Also, the securement occurs solely between the lip portion 151, and the connection thereof to the lip part 48 of the control body, together with the securement of the upper portion of the shell back part 31 to the upper part 62 of the upright 23, as explained below.

Figure 16:
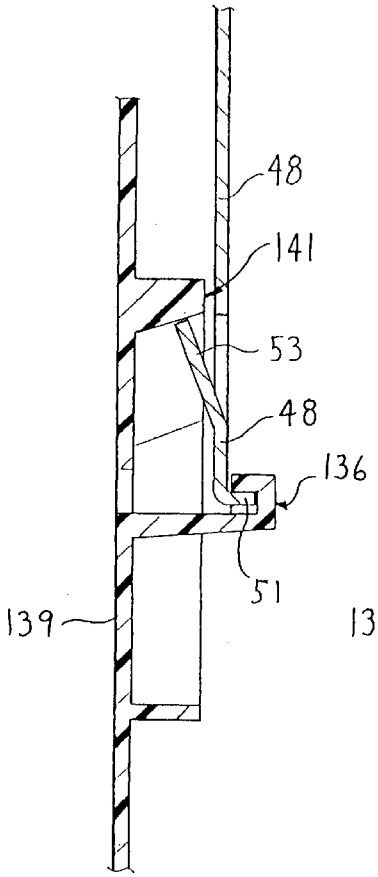
FIGS. 16 and 17 are views which respectively correspond FIGS. 11 and 12 but show the seat part of the chair shell engaged with the front lip part of the control body.
Figure 17:
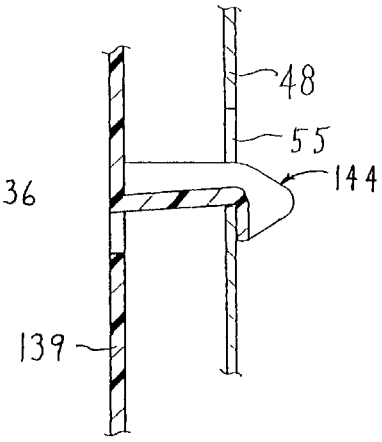

To secure the shell 29 to the control 21, the lip portion 151 of the seat part 32 is secured first. This is accomplished by positioning the lip part 151 of the shell adjacent the front edge of the control body 22, with the shell being positioned so that the seat part 32 projects generally vertically upwardly. The shell is oriented closely adjacent the front edge of the control so that the front securing flanges 51 on the control body are aligned with and inserted into the mouth 138 of the grooves 137 associated with the U-shaped retaining flanges 136. When so positioned, the seat part 32 is then rotated rearwardly about 90° so as to overlie the control, thereby causing the securing flanges 51 to be rotated into and secured within the L-shaped grooves 137 defined by the retaining flanges 136 as shown in FIG. 16. This creates a fixed securement of the lip portion 151 of the shell to the front of the control body 22. The seat part of the shell is then pushed downwardly toward the control body until the stop flanges 53 project into the channels 142 defined in the U-shaped stop blocks 141, whereon the free edges 54 of the stop flanges 53 are disposed closely adjacent the wall 143, as shown in FIG. 16. This cooperation prevents the seat part 32 of the shell from moving forwardly relative to the control body.

Also during this downwardly movement of the seat part of the shell into engagement with the control body, the cam 146A on the retainer latch 146 engages the front edge of the opening or window 55 formed through the lip part 48 of the control body, causing this L-shaped latch 146 to be resiliently deflected rearwardly until the retainer 146 passes through the window 55, at which time the latch snaps forwardly so that the retainer flange 148 engages beneath the lip part 48 adjacent the front edge of the window 55.

Figure 15:
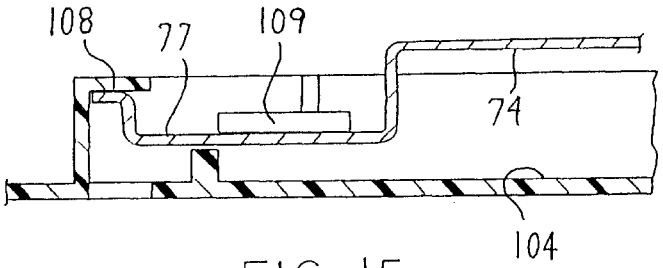
FIGS. 14 and 15 are views which respectively correspond FIGS. 9 and 10 but show the back part of the chair shell engaged with the upright.
Figure 14:
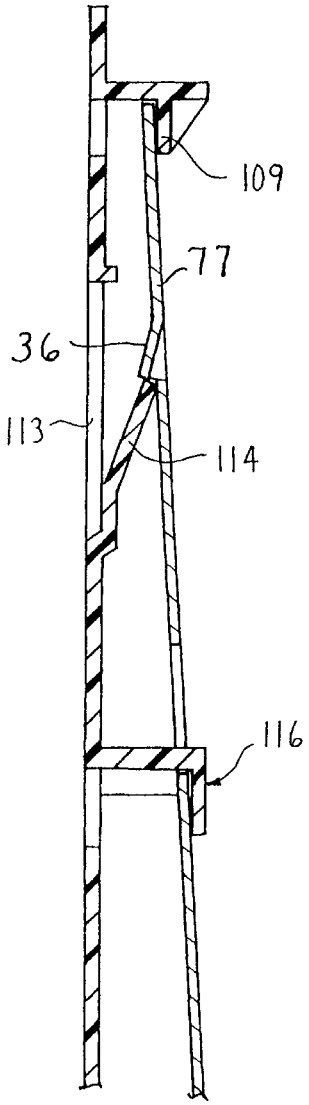

With the front seat part 32 latched to the lip part 48 of the control body 22 as described above, the upper portion of the back part 31 of the shell is then engaged to the upper part 62 of the upright 23. To accomplish this, the upper part 31 is suitably flexed, as permitted by the arcuate portion 33, so as to enable the upper part 62 of the upright to be inserted into the channel 107, with the upper shell part 31 then being forced downwardly onto the upright until the upper free edge 73 of the upright substantially abuts the top rib 106. When in this position, the corner securing flanges 108 overlie the upper outer corners of the upright (FIG. 15), and the other securing flanges 109 overlie the upper free edge 73 of the upright in the vicinity of the front wall portions 77 (FIG. 14). This secures the upper end of the upright 23 to the upper shell part 31.

During the above engagement, the guide plates 112 are snugly slidably inserted into the slot 79 which is formed in the rear wall 76 and opens downwardly from the upper free edge 73.

At the same time, the L-shaped latches 116 are inserted through the openings or windows 38, whereupon the retainer flanges 118 provided on the free ends of latches 116 then pass downwardly behind the tabs 39 (FIG. 14) when the shell part 32 is pushed downwardly onto the upper end of the upright.

During this latter engagement, the cantilevered stop flanges 114 provided on the shell slide downwardly along the tapered stops 36 formed on the upright. When the shell part 31 has been moved downwardly so as to be properly seated on the upper end of the upright 23, the free ends of the resilient stop flanges 114 pass over the free edges 37 of the stops 36 and resiliently snap into a position whereby the free edges of the flanges 114 are engaged under the free edges of the stops 36 (FIG. 14), thereby preventing the shell part 31 from being dislodged upwardly away from the upright 23.

With the chair shell 29 fixedly secured to the control mechanism by the connections described above, which connections are disposed solely adjacent the upper and front ends of the shell, the shell is thus properly secured to the control mechanism without requiring fasteners or similar extraneous connectors.

Further, the central portion of the shell, namely the rear portion 154 of the seat part as well as the lower back portion and the arcuate part 33, are all free of any fixed securement to the control mechanism. The bearing hubs 148 associated with the seat part 31 of the shell, however, are disposed in slidable engagement with the slide surfaces or tracks 78 associated with the upright 23.

Figure 18:
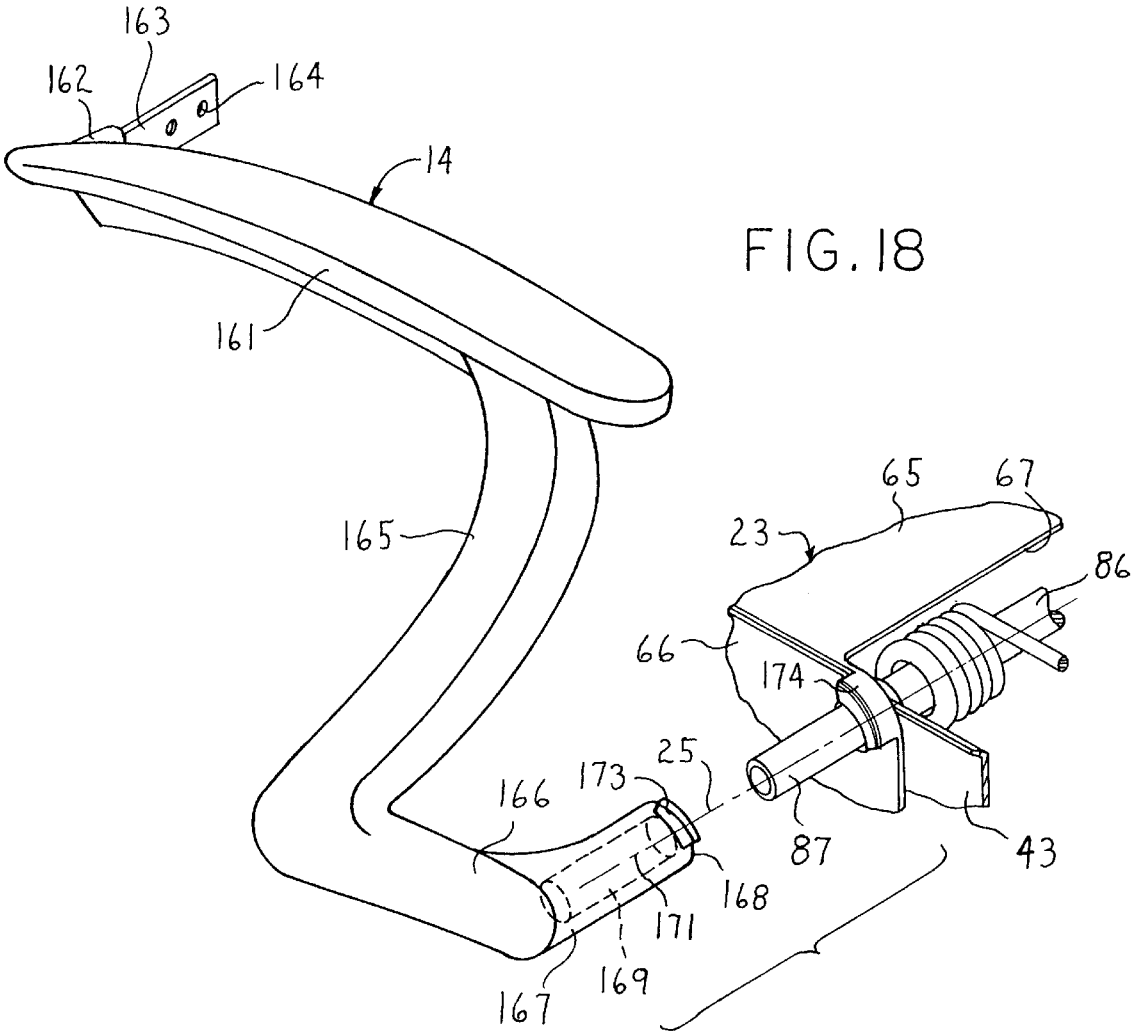
FIG. 18 is an exploded, fragmentary, perspective view which illustrates the connection of the chair arm to the control mechanism.
Figure 19:
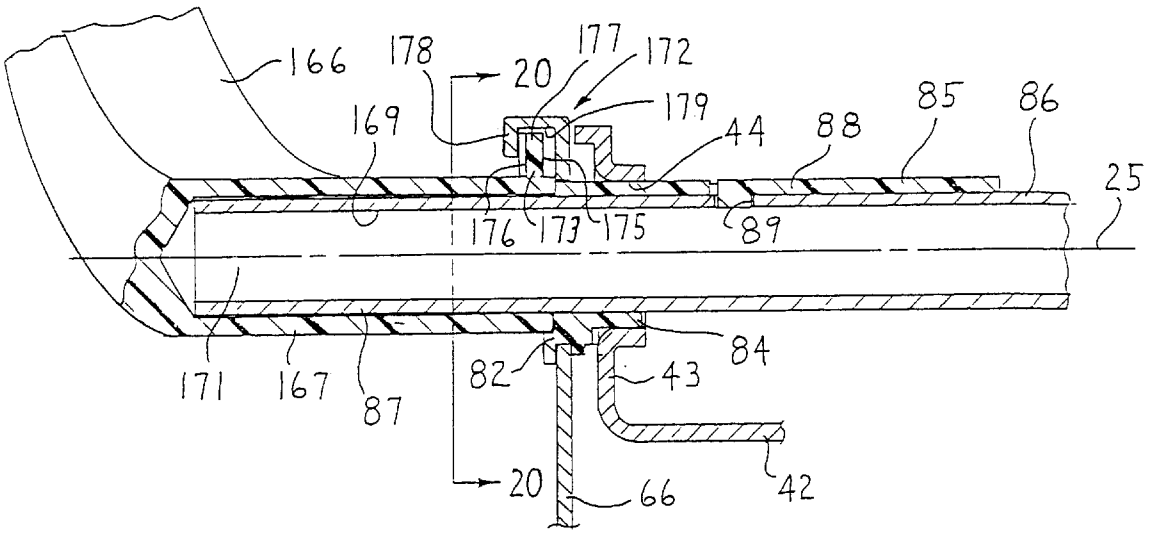
FIG. 19 is an enlarged, fragmentary sectional view taken substantially along line 19—19 in FIG. 20.
Figure 20:
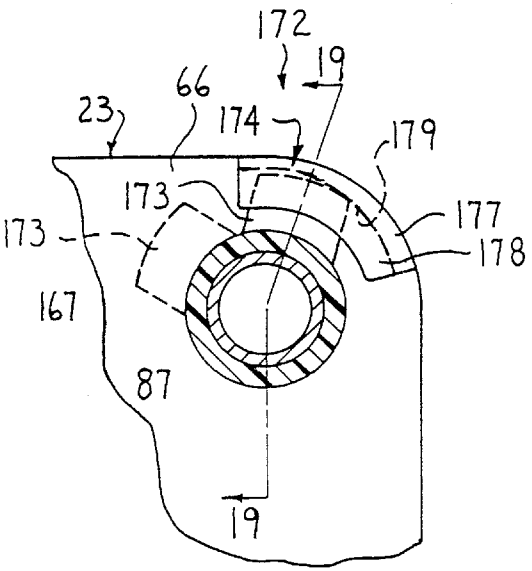
FIG. 20 is an enlarged, fragmentary sectional view taken generally along line 20—20 in FIG. 19.

Chair Side Arms:

Consideration will now be given to the manner in which the side arms 14 are connected to the chair, and in this respect reference is made to FIGS. 18–20.

Figure 7:
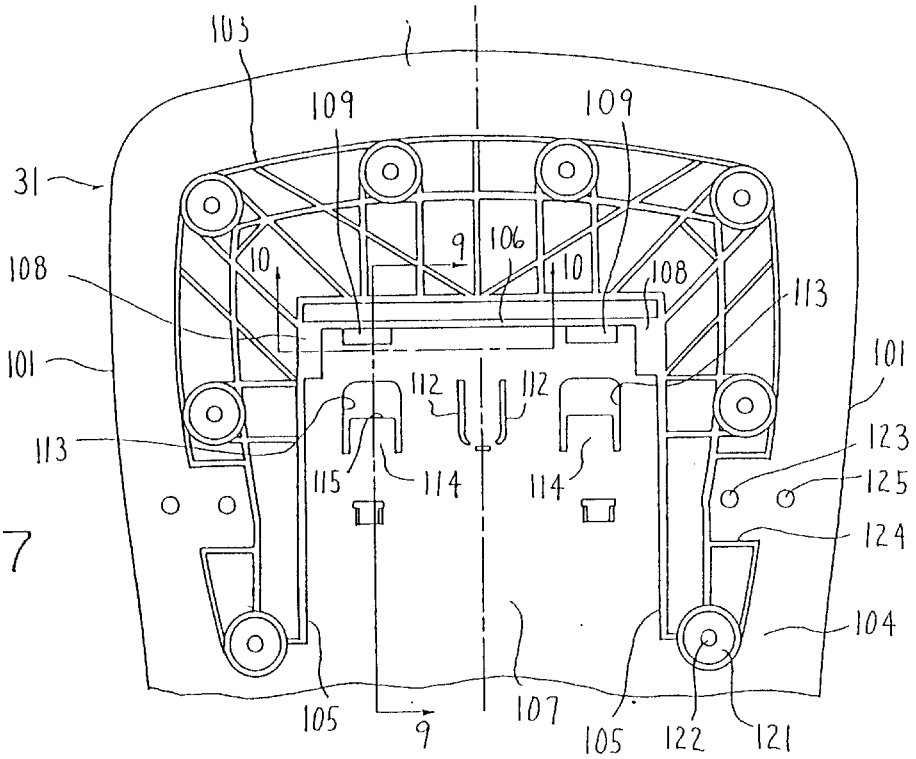
FIG. 7 is a view of the rear side of the back part of the chair shell, which back side is shown flat for convenience in illustration.

Each side arm 14 includes a generally horizontally elongated armrest 161 which is positionable in upwardly spaced relationship adjacent one side of the chair seat. The armrest 161 adjacent its rearward end is fixedly joined to a short securing arm 162 which projects approximately horizontally sidewardly toward the adjacent side edge of the chair back for connection thereto. This securing arm 162 is cantilevered and terminates in a generally vertically oriented mounting plate 163 having a pair of openings 164 therethrough. This mounting plate 163 projects into the interior of the chair back so that the mounting plate 163 generally overlies the back surface of the chair shell and is accommodated within the slot 124 (FIG. 7). When so positioned the holes 164 in the mounting plate align with the openings 125 formed through the shell, and appropriate fasteners such as screws are inserted through these aligned openings to fixedly secure the mounting plate 163 to the shell.

The chair arm 14, at the front end of the armrest 161, is provided with an elongate support 165 which projects generally downwardly and also angles somewhat rearwardly and, at its lower end, is provided with a short portion 166 which is directed generally inwardly toward the seat. This inward portion 166 in turn joins to a generally cylindrical hub 167 which is cantilevered horizontally inwardly so as to terminate in a free end 168. This hub defines therein a blind bore or opening 169 which opens inwardly from the free end 168. This bore 169 is of a generally cylindrical cross section dimensioned so as to snugly accommodate therein the cantilevered projecting end portion 87 of the main pivot shaft 86. The axis 171 of this opening 169 aligns with the shaft axis 25 when the hub 167 is mounted on the main pivot shaft.

To permit fixed securement of the chair arm hub 167 to the seat subassembly, a camming or wedging type locking arrangement 172 cooperates between the chair arm hub 167 and the adjacent side wall 66 of the upright 23. This locking arrangement 172 includes cooperating cam parts 173 and 174 which are respectively defined on the hub 167 and the side wall 66. The cam part 173 comprises a wedgelike flange or cam which projects radially outwardly from the chair arm hub 167 adjacent the free end thereof, which part 173 extends circumferentially of the hub through only a small angular extent. This wedge or cam part 173 is of a platelike construction having a rather small dimension in the axial direction, which small axial dimension is defined between generally parallel side walls 175 and 176. These side walls, however, extend at a small angle relative to a plane which perpendicularly intersects the axis 171 so as to create a angled cam or wedge relationship relative to the axis 171.

The other cam part 174 is fixed to and projects outwardly from the side wall 66 of the upright 23. This cam part 174 includes an arcuate wall 177 which projects outwardly in generally perpendicular relationship from the side wall 66, with this arcuate wall 177 being centered approximately about the axis 25 and positioned radially outwardly of the respective opening 68 so as to extend arcuately through a small circumferential extent about this opening. This arcuate wall 177 in turn has a rib or flange 178 fixed to the outer edge thereof, which rib or flange 178 projects radially inwardly a limited extent generally toward the axis. The side wall 66, arcuate wall 177 and rib 178 define an elongate groove 179 which opens radially toward the opening 68 and extends circumferentially thereof through a limited arcuate extent. This groove 178 has a width in the axial direction which is slightly smaller than the overall axial dimension of the cam part 173 so that the latter will create a snug or interference fit within the groove.

To attach the chair arm 14 to the chair controller, the arm is positioned so that the hub 167 is substantially aligned with the projecting shaft end 87, and the chair arm is additionally rotated rearwardly about the support hub 167 so that the arm rest 161 projects generally vertically downwardly. The hub 167 is slidably inserted over the projecting shaft end 87 so as to cause the cam part 173 to be disposed adjacent and substantially circumferentially aligned with one end of the groove 179, as indicated by dotted lines in FIG. 19. The chair arm is then rotated forwardly through an angle of about 90° so as to assume its proper mounting position relative to the chair. This rotation causes the cam part 173 to enter into the groove 179 of the cam part 174. Due to the wedge configuration of the cam part 173, the side surface 176 initially slidably contacts the outer wall 178 and causes the hub 167 to be drawn axially inwardly to snug up against the upright during the rotation of the wedge into the groove. At the same time, as the wedge 173 approaches the end of the assembly rotation, the outer peripheral surface thereof wedges against the inner surface of arcuate wall 177 to eliminate radial clearance so that hub 167 snugly seats on shaft 87. This hence creates a secure and substantially fixed connection between the chair support hub 167, the upright 23, and the shaft 86. In addition, the arm support hub 167 is properly supported due to its being engaged on the projecting shaft end 87.

After the chair support hub 167 has been rotated so that the cam part 173 thereon fixedly engages the cam part 174 on the upright 23, this then results in the mounting plate 163 being disposed generally adjacent the upper part of the upright. The chair shell 29 can then be positioned over and attached to the control mechanism in the manner described above, thus resulting in the mounting plate 163 being properly positioned adjacent the back part 31 of the shell so as to be securable thereto by fasteners or the like in the manner described above.

Tilt Lock Mechanism:

To enable the chair occupant to provide for a rigidified positioning of the seat-back assembly 11 when desired, including specifically the ability to lock the seat-back assembly in at least the normal upright position, the chair of this invention incorporates thereon an improved tilt lock mechanism associated with the control assembly 21 for cooperation between the control body 22 and the upright 23.

The tilt lock mechanism of this invention is designed to permit the seat-back assembly 11 to be locked not only in its upright position, such being conventional in chairs of this general type, but to also permit the seat-back assembly to be locked in a rearwardly tilted position. This latter position is one wherein the chair back is tilted only partway away from the upright position, such as a tilt of about 5° of the back assembly away from the upright position, as explained hereinafter.

As illustrated by FIGS. 22–26, the tilt lock mechanism 211 includes a lock member 212 which is formed generally as a vertically enlarged plate. This member 212 is positioned directly adjacent but rearwardly of the top flange 46 associated with the rear wall 45 of the control body 22. The lock plate 212 is pivotally suspended downwardly from the top or base wall 65 of the upright 23, with the lock plate 212 having upwardly and forwardly projecting hinging flanges 213 which project upwardly through slots formed in the base wall 65 for permitting pivoting suspension of the lock member directly adjacent the rear of the control body 22.

The lock plate 212 extends transversely across a significant portion of the rear width of the control body and is provided with a pair of stops 214 projecting outwardly from the front face 215 thereof. The stops 214 are uniformly spaced on opposite sides of the longitudinal centerline 209. These stops 214 are disposed downwardly a significant distance below the hinge flanges 213 and are disposed so that the lowermost surfaces of the stops 214 are positioned substantially at and generally slightly above the upper surface of the top rear flange 46 on the housing when the seat-back assembly 11 is in its normal or full upright position. Thus, when the lock plate 212 is moved into its locking position as illustrated by dotted lines in FIG. 24, these stops 214 are positioned directly over the rear top flange 46 and prevent rearward tilting of the upright 23 relative to the control body 22. This thus maintains the seat-back assembly 11 locked in the upright position, which position is shown in solid lines in FIG. 21 and is designated as AA.

Figure 25:
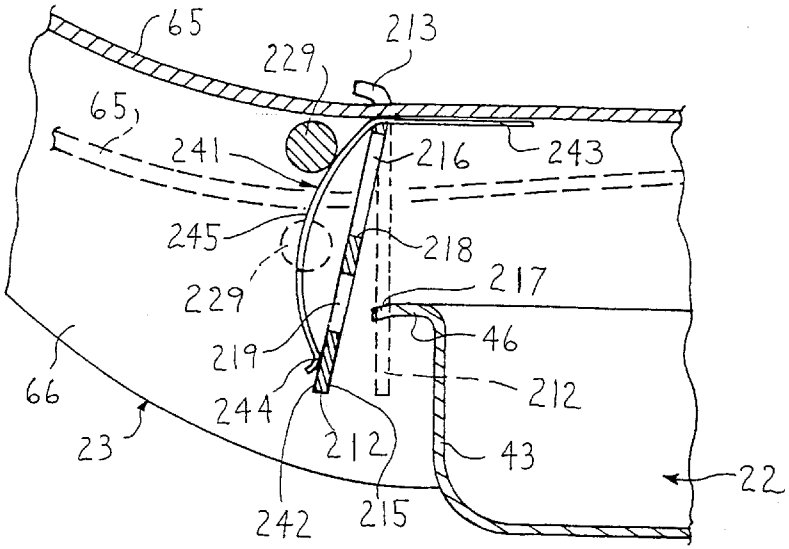
FIGS. 24, 25 and 26 are fragmentary sectional views respectively taken along lines 24—24, 25—25 and 26—26 in FIG. 22, with FIGS. 24 and 25 also showing in dotted lines the tilt lock plate in its locked position.
Figure 24:
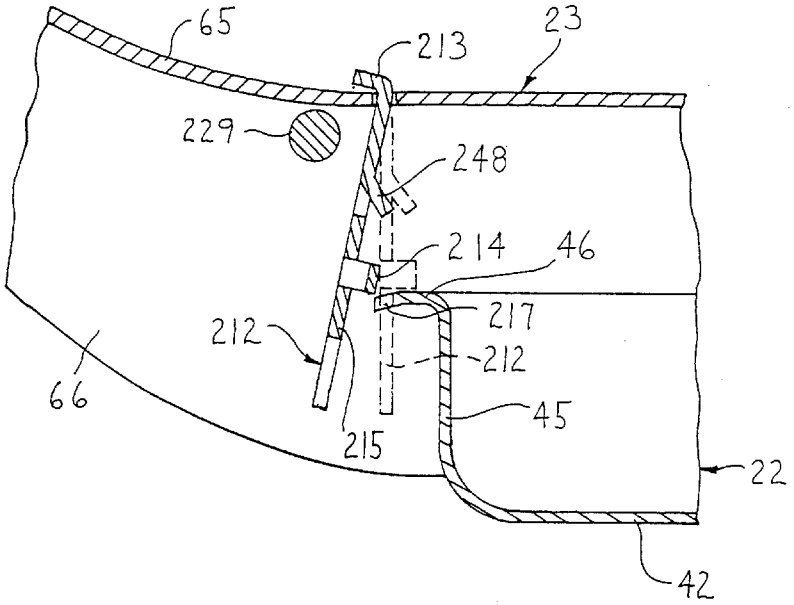
Figure 26:
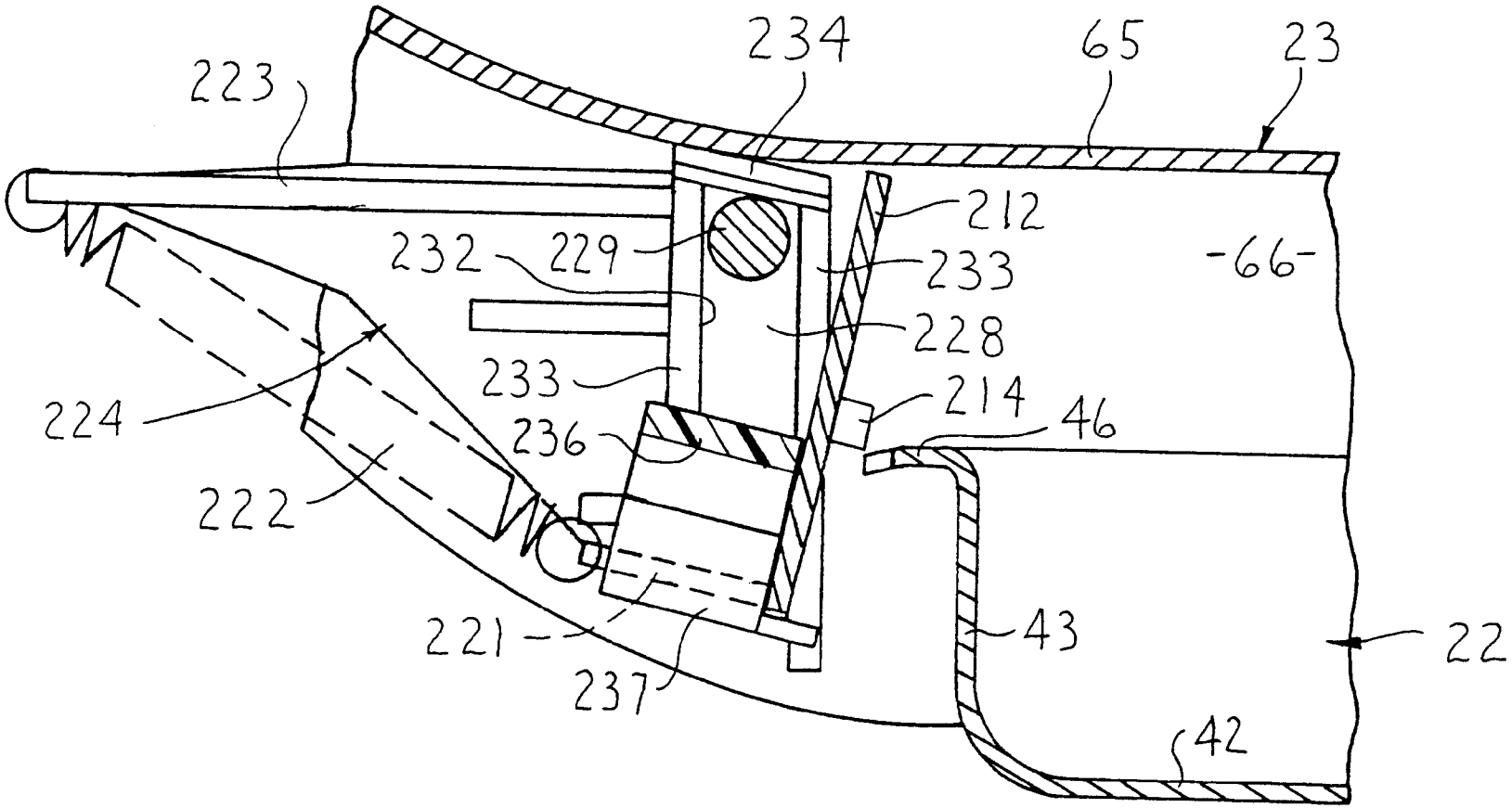

Lock member 212 also has a substantially rectangular window or opening 216 formed therethrough, which opening is centered along the centerline 209 and terminates in a lower edge or stop surface 218. This opening 216 and specifically the lower edge 218 thereof is positioned at an elevation above the rear stop flange 46 when the seat-back assembly 11 is in the full upright position, substantially as illustrated by FIGS. 22 and 25. The rear upper flange 46 of the control body, however, is provided with a locking flange or stop 217 which is cantilevered rearwardly outwardly a limited extent beyond the rear edge of the top flange 46, with this stop 217 being centrally positioned so as to be alignable with the opening 216 when the seat-back assembly 11 is tilted at least into an intermediate tilt position (such as position BB in FIG. 21), which intermediate tilt position will normally require at least a rearward tilt angle of 5° with respect to the seat back. When in this intermediate tilt position, this results in lowering of the locking plate 212 due to rearward and downward pivoting of the upright 23 so that the rear edge 218 of the opening 216 is lowered to an elevation below the locking flange 217. If the locking plate 212 is then moved into the locking position wherein it substantially abuts the top rear flange 46, this results in the locking flange 217 projecting into the opening 216 so as to overlie the lower stop surface or edge 218. When in the defined intermediate tilt position, the lower edge 218 engages under the stop flange 217 and prevents the seat-back assembly from being returned to its upright position.

Figure 21:
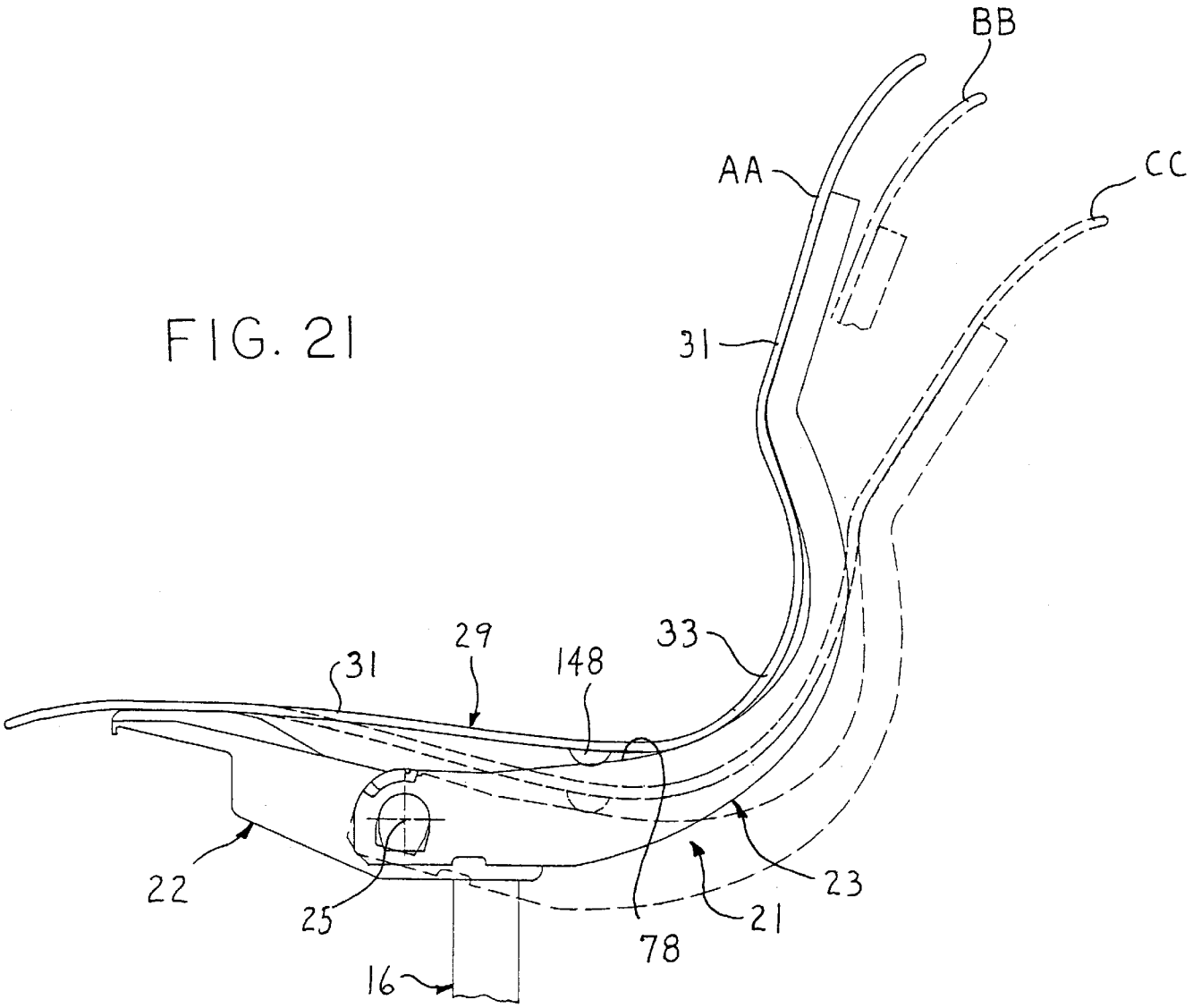
FIG. 21 is a side elevational view showing attachment of the chair shell to the control mechanism, and showing the normal upright position in solid lines, a maximum tilted position in dotted lines, and a partial intermediate tilted position.
Figure 22:
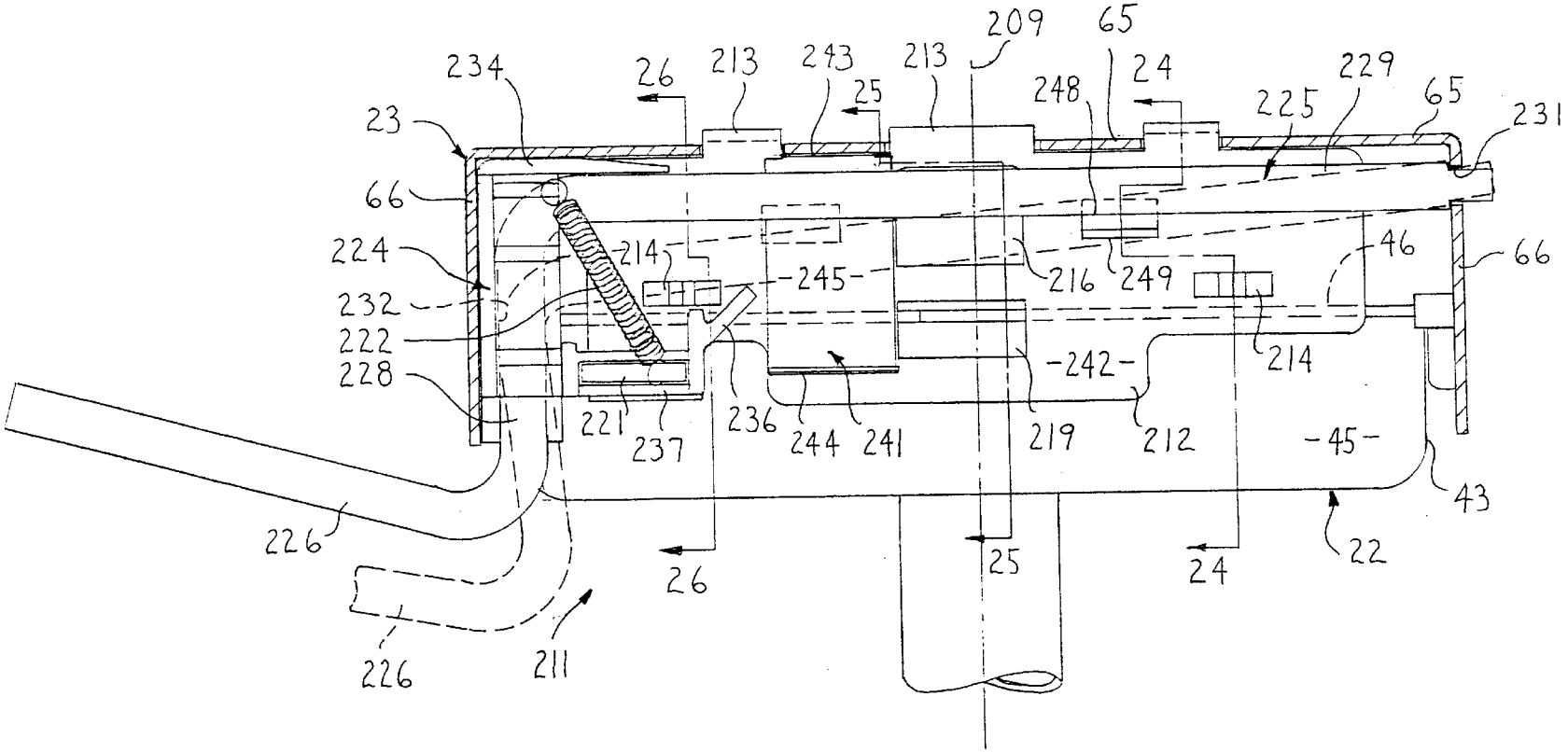
FIG. 22 is an enlarged elevational view showing the tilt control mechanism which cooperates between the upright and the control body, which view is taken generally along line 22—22 in FIG. 4.
Figure 23:
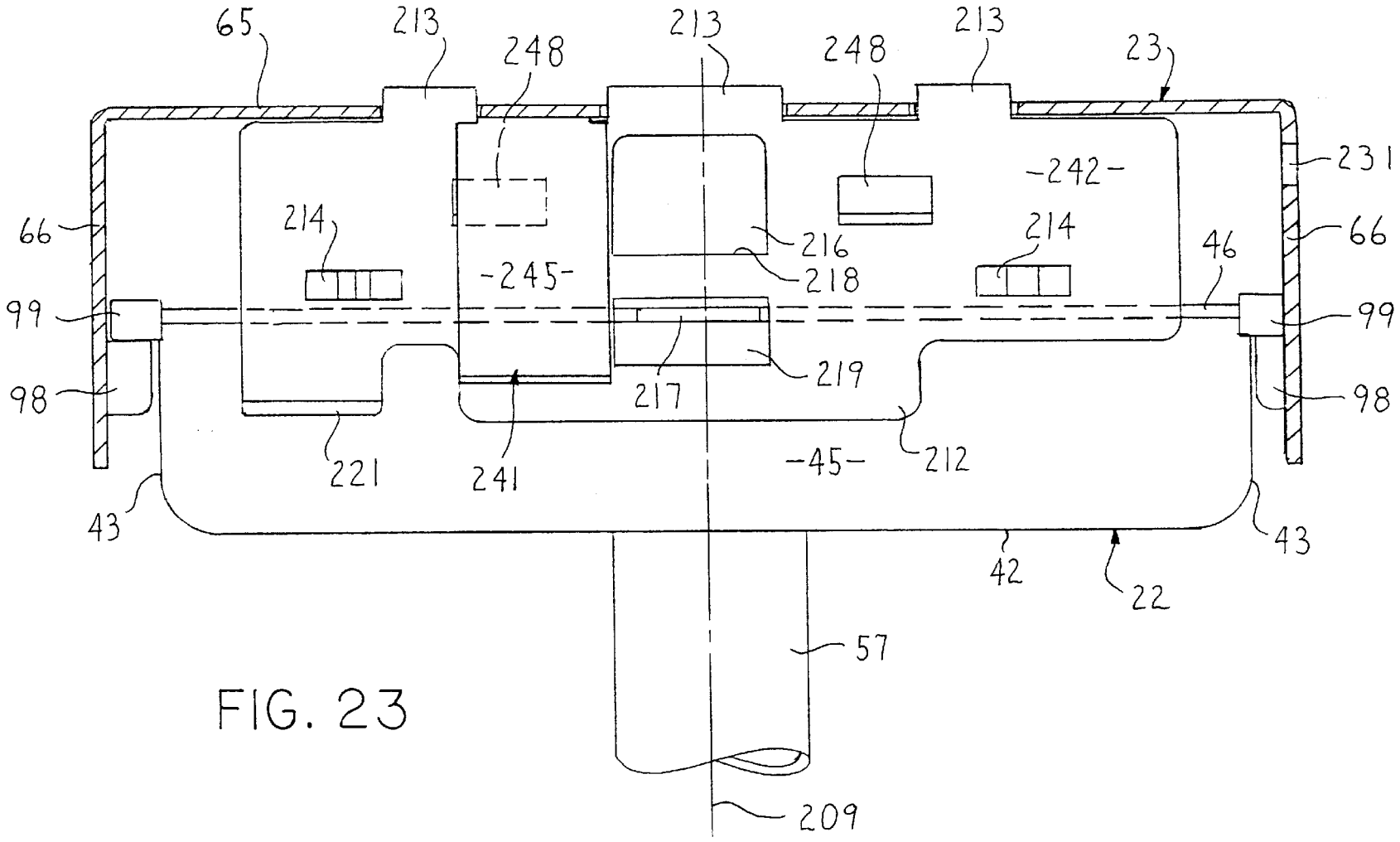
FIG. 23 is a view similar to FIG. 22, but with parts of the tilt control mechanism eliminated for purposes of illustration.

When in this latter position, while the engagement of the stop flange 217 with the bottom edge or surface 218 prevents the chair from returning to its upright position, it does not by itself prevent the seat-back assembly from being tilted further rearwardly away from the intermediate position, such as toward the full tilt position CC shown in FIG. 21. Accordingly, the lock plate 212 includes thereon a pair of stop tabs 248 which are positioned symmetrically on opposite sides of the longitudinal centerline 209. These stops tabs 248 project outwardly from the front surface 215, and are formed as ramps which incline or slope outwardly away from the surface 215 as they project downwardly so as to terminate at free ends 249 which effectively define downwardly-facing shoulders. These shoulders 249 are positioned at an elevation which is spaced upwardly from the elevation of the lower edge 218 by a distance which slightly exceeds the thickness of the rear top flange 46. When the locking tab 217 projects into the access window 216 and is engaged with the rear edge 218, then at the same time the stop tabs 248 project directly over the upper surface of the rear top flange 46. This captivates the top flange 46 between the stop tabs 248 and the stop surface 218 and prevents movement of the seat-back assembly either forwardly or rearwardly away from this intermediate tilt position BB without first releasing the tilt lock mechanism 211.

In addition, due to the vertical dimension of the opening 216, this opening is sized such that the occupant can tilt the seat-back assembly 11 rearwardly significantly beyond the lockable intermediate position BB, and then activate the lock mechanism 211 so as to swing the lock plate 212 forwardly into a locking position. This enables the locking flange 217 to project into the upper part of the opening 216. As the seat-back 11 is then permitted to tilt forwardly toward position BB under the control of the occupant, the lock plate 212 will move upwardly relative to the control body. The tapered stop tabs 248 will momentarily cam the lock plate 212 rearwardly until the tabs pass over the top flange 46, following which the plate 212 will be spring-urged forwardly so that the locking flange 217 is substantially engaged with the bottom stop surface 218, and the stop tabs 248 are positioned directly over the top flange 46, thereby locking the seat-back assembly in the intermediate tilt position. By tilting rearwardly past the intermediate position BB and then engaging the lock mechanism 211, the chair occupant can then allow the chair to tilt forwardly in a controlled manner and the lock mechanism will automatically engage so as to lock the seat-back assembly in the intermediate tilt position.

The lock plate 212 has a further opening 219 formed therethrough along the centerline thereof. This opening 219 is positioned closely adjacent and spaced downwardly from the opening 216. Opening 219 functions solely as a clearance opening to accommodate therein the locking flange 217 when the tilt lock plate 212 is in the locking position and the seat-back assembly 11 is in either its upright position or in a partially tilted position disposed between the upright position AA and the intermediate tilt position BB.

Lock plate 212, adjacent the lower corner thereof, is provided with a tab or flange 221 which projects rearwardly from the plate. A forward end of an elongate tension spring 222 is connected to this tab 221, and the spring 222 projects generally rearwardly and has the other end thereof anchored to a leg or arm 223 of a bracket 224. This bracket 224 is fixedly secured to the side wall 66 of the upright and is disposed so as to directly overlie the inside surface thereof.

To activate the lock plate 212, the lock mechanism 211 includes an elongate and generally Z-shaped actuator rod 225 which projects outwardly through one side of the seat subassembly. This actuator rod 225 includes an outer elongate rod portion 226 which projects outwardly from generally beneath and adjacent one side of the seat assembly. Rod portion 226 is provided with a conventional actuating knob 227 on the free end thereof. The rod portion 226 at its inner end is bent upwardly to define an intermediate upright rod portion 228 which projects upwardly into the seat subassembly directly adjacent the inside surface of the side wall 66. The intermediate upright rod portion 228 at its upper end in turn is again bent so as to define a generally horizontally elongate inner rod portion 229 which projects transversely across the upright at a location which is spaced rearwardly of the lock plate 212 and slightly downwardly from the top wall 65. This inner rod portion 229 at its free end is supportingly engaged within an opening 231 associated with the side wall 66 on the opposite side of the upright. The end of the rod part 229 is suitably configured, such as flattened, so as to enable its connection within the opening 231 to effectively function as a vertical pivotable support for the actuator rod 225.

The intermediate upright portion 228 of the actuator rod is longitudinally slidably guided and confined within a channel 232 which is formed on and projects generally vertically of the bracket 224. This channel is defined generally between parallel side walls 233, with the upper end of this channel being closed by a stop plate 234 which is positioned close to the top wall 65. The bracket 224 is preferably constructed of a plastics material so as to facilitate the slidable support of the intermediate rod part 228 within the channel, and at the same time the top stop plate 234 is engageable with the inner rod portion 229 for defining the uppermost position of the actuator rod. This uppermost position as illustrated by solid lines in FIG. 22 and defines the "release" position for the tilt lock mechanism 211.

The bottom tab 221 on the lock plate also mounts thereon and is surrounded by a plastic sleeve part 237, the latter being retained on the tab due to the securement of the spring to the tab adjacent the free end thereof. This sleeve part 237 has a plastic flange 236 projecting outwardly and upwardly therefrom. Flange 236 is disposed so as to be contacted by the rod portion 229 when the actuator rod is pivoted downwardly into a "locking" position substantially as indicated by dotted lines in FIG. 22.

To provide for control over movement of the locking plate 212 into the engaged or locked position, the mechanism 211 includes a spring 241 which is disposed adjacent the rear surface 242 of the locking plate and cooperates with the interior rod portion 229 of the actuator rod. This spring 241 is formed from flat platelike spring material and includes a mounting flange 243 at the upper end thereof. This flange 246 projects over the upper edge of the lock plate 212 and is disposed directly under the top wall 65 so as to captivate the spring. The spring 241 projects downwardly from the top mounting flange 243 and terminates in a lower free end 244 which effectively contacts the rear surface 242 of the lock plate 212 adjacent the lower free edge thereof. The spring 241 defines thereon an outer surface 245 which, as it projects downwardly from the mounting flange 243 to the free end 244, is of a generally outwardly bowed convex configuration, this being the general configuration of the spring, substantially as illustrated by FIG. 25. The actuator rod portion 229 always remain in contact with the spring surface 245 and slides along this surface when the actuator rod is moved between the raised and lowered (i.e., released and locked) positions indicated by FIGS. 22 and 25.

More specifically, when the actuator rod 225 is in the released position substantially as indicated by solid lines in FIGS. 22 and 25, the rod portion 229 is disposed adjacent the top wall 65 and engages the spring surface 245 at a location spaced slightly downwardly from the mounting flange 243. At this point of engagement, the spring 241 has a minimal displacement rearwardly from the lock plate due to the bowed characteristics of the spring.

However, when the actuator rod 225 is activated downwardly into the locked position as indicated by dotted lines in FIGS. 22 and 25, the rod portion 229 slides downwardly along the spring surface 245, which spring reacts against the lock plate 212 and swings it over into contact with the top flange 46, as indicated by dotted lines in FIG. 25. When the rod portion 229 reaches the lowermost locking position as indicated by dotted lines in FIG. 25, the spring 241 is effectively partially compressed between the actuator rod portion 229 and the locking plate 212, whereby the latter is maintained in engagement with the rear top flange 46. At the same time the engagement between the rod portion 229 and the spring surface 245 is such as to effectively maintain the rod portion in its lowermost locking position. Release of the lock mechanism 211 will not occur until the chair occupant manually engages and pivots the actuator rod 225 upwardly back to its released position.

Figure 27:
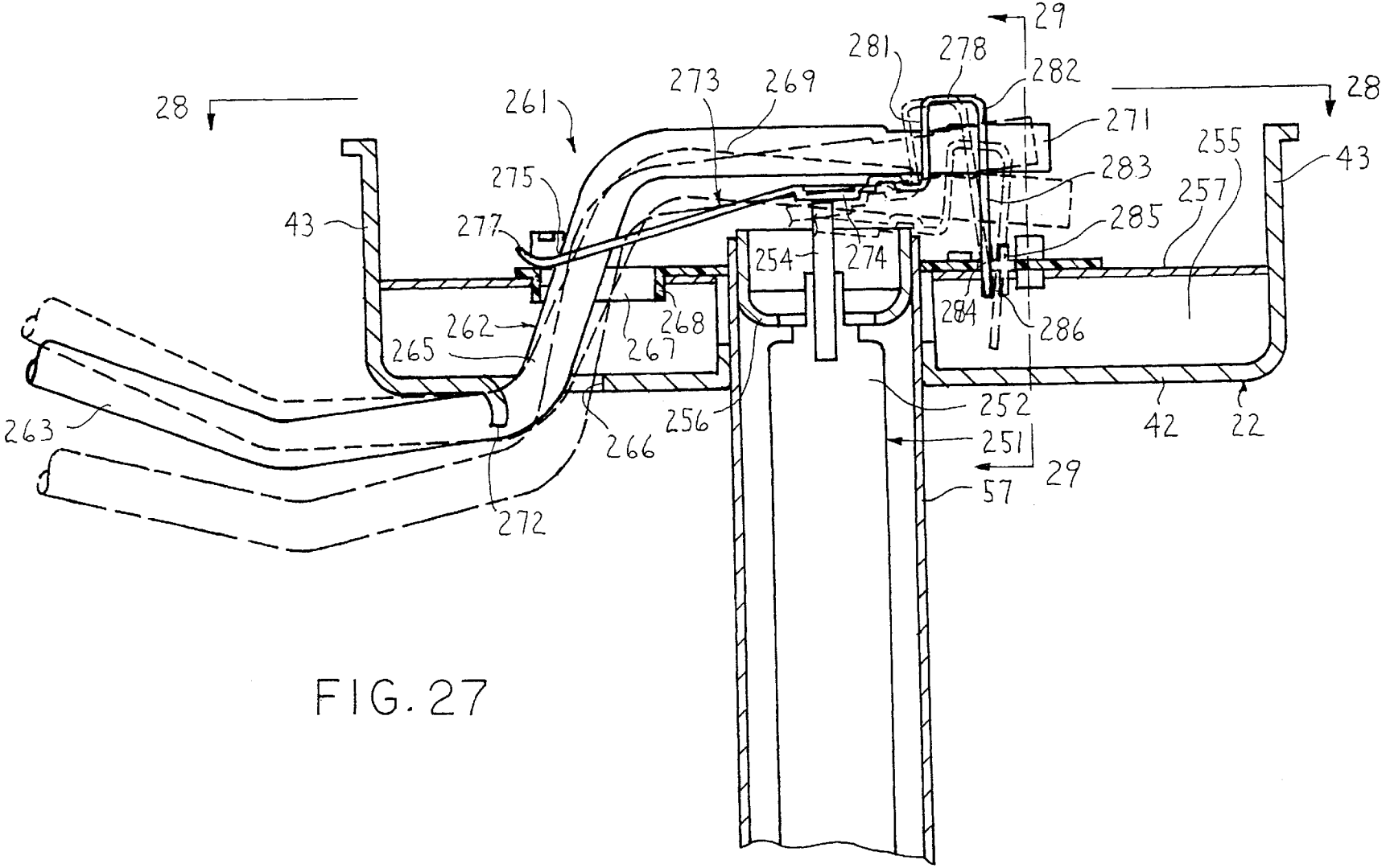
FIG. 27 is an elevational view taken generally along line 27—27 in FIG. 4 and illustrating the lift cylinder control mechanism.

Lift Control Mechanism:

To adjust the height of the seat-back assembly 11, the pedestal assembly 15 in a preferred embodiment of the invention incorporates therein a vertically elongate airlift cylinder (or pneumatic spring) 251 (FIG. 27). The pneumatic spring 251 has an elongate housing 252 and a piston rod 253 (FIG. 2) projects outwardly from the lower end thereof. This piston rod has the lower end thereof anchored to the chair base 16, and the pneumatic spring projects upwardly through the guide tube 57 whereby the upper end of the cylinder housing 252 is fixedly secured to the bottom of the control body 22 so that the pneumatic spring is extendable and contractible generally along the vertical longitudinal pedestal axis 17.

Figure 28:
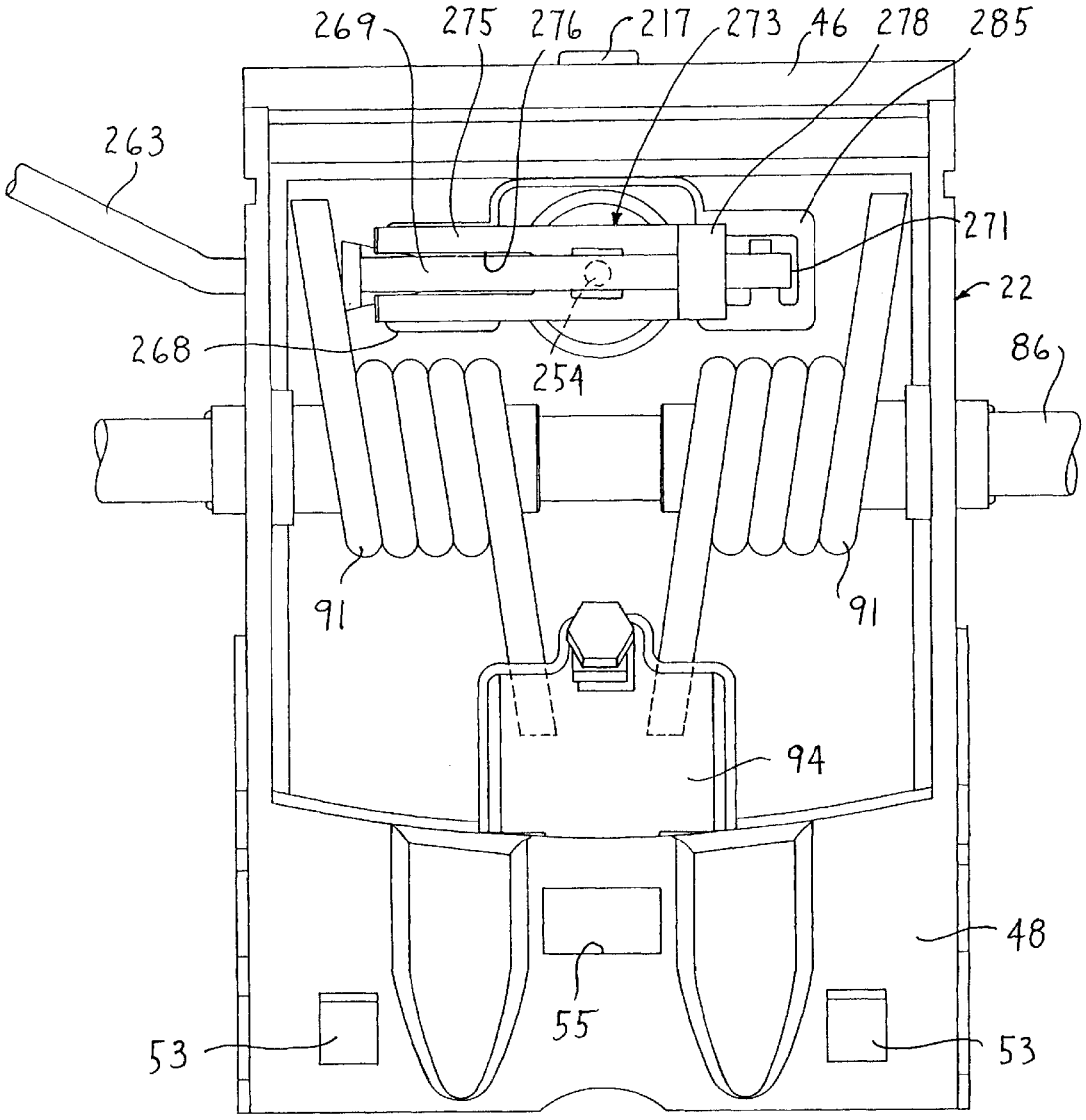
FIGS. 28 and 29 are views taken respectively along lines 28—28 and 29—29 in FIG. 27.
Figure 29:
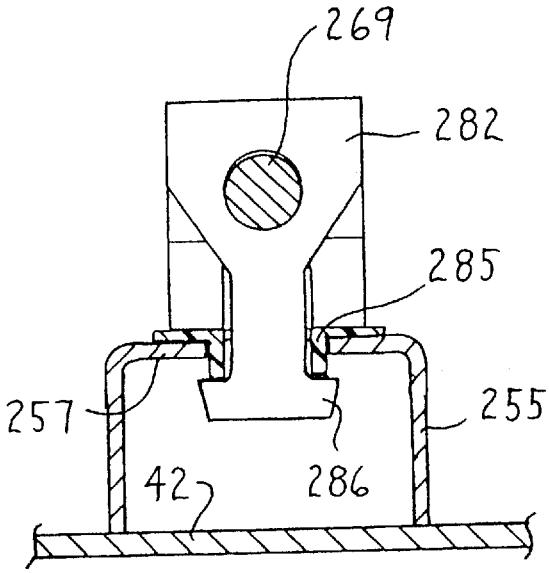
Figure 30:
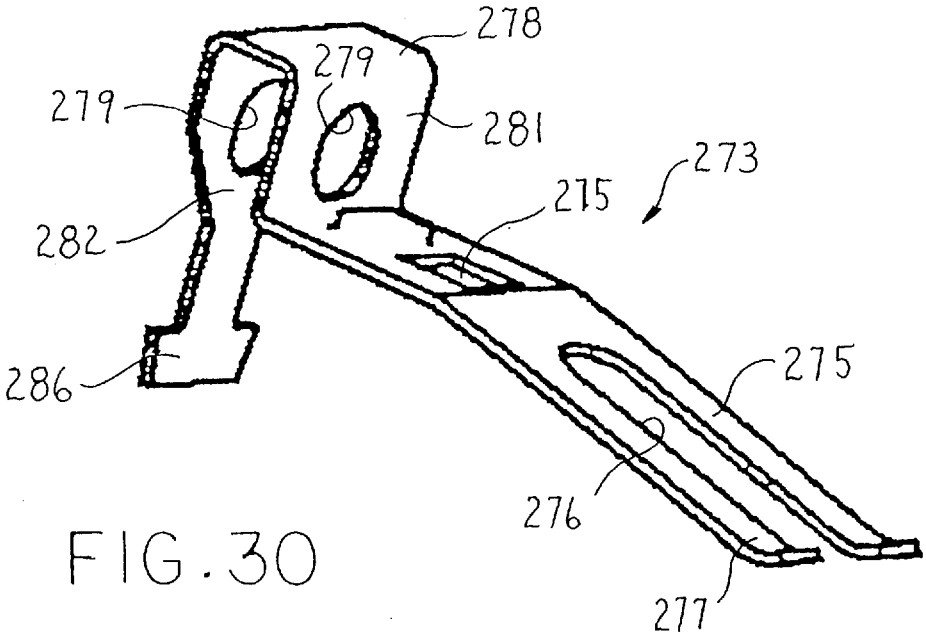
FIG. 30 is a perspective view of the resilient actuator member for the lift control mechanism.

As illustrated by FIGS. 27–29, the cup-shaped housing of the control body 22 has a cross piece 255 fixedly secured therein, which cross piece 255 is a generally downwardly-opening channel member which substantially bears on and extends transversely across the bottom wall of the control housing. A generally cup-shaped securing member 256 fixedly couples the upper end of the cylinder housing 252 to the cross piece. The upper end of the pneumatic spring has an axially movable valve actuator 254 projecting axially upwardly above the top wall 257 of the cross piece 255. The valve actuator 254 is normally maintained in an upwardly extended position, whereby the interior valve of the pneumatic spring 251 is closed so as to lock the spring in a set position. Depression of the valve actuator 254 opens the valve and enables movement of the internal piston relative to the housing so that the air cylinder 251 is normally urged into an extended position to cause raising of the seat-back assembly.

The overall construction and assembly of the pneumatic spring 251, and its mode of connection to a chair for adjusting chair height, is conventional and well known.

The chair 10 in the preferred embodiment thereof includes an improved lift control mechanism 261 (FIGS. 27–30) for activating the valve actuator 254 of the pneumatic lift cylinder 251. This lift control mechanism 261 includes a generally Z-shaped actuator rod 262 which includes an outer elongate rod part 263 which projects sidewardly away from one side of the seat assembly, and which is provided with an actuating knob 264 secured to the free end thereof. This outer rod part 263 projects into the underside of the seat assembly and is suitably bent so as to define an intermediate rod part 265 which projects upwardly through an opening 266 formed in the bottom wall of the control body. This intermediate rod part 265 projects upwardly through the control body and through a further opening 267 defined in the top wall 257 of the cross piece 255. The opening 267 is preferably formed as an elongated slot defined by a plastic bearing member 268 which is seated on the cross piece, with this slot being elongated inwardly toward the lift cylinder. This intermediate upright rod part 265, at a location above the top wall 257, is bent inwardly so as to define an elongate top rod part 269 which projects transversely of the control body generally across but spaced slightly above the valve actuator 254. This top rod part 269 terminates in a free end 271 which is disposed on the side of the control body opposite from the intermediate rod part 265.

The outer rod part 263, where it bends up into the intermediate rod part 265, is engageable with a flange 272 which is formed adjacent the opening 266. This flange 272 effectively functions as a pivot point or fulcrum when the rod part 263 is lifted upwardly to pivot the rod 262 clockwise in FIG. 30.

To depress the valve actuator 254 in response to vertical pivoting of the actuator rod 262, the lift control mechanism 261 includes a one-piece actuator member 273 which is, in a preferred embodiment, formed generally from a piece of thin and generally flat spring plate. This actuator member 273 includes a platelike actuator part 274 which is disposed under the top rod part 269 and is normally maintained in engagement with the upper end of the valve actuator 254. An elongate cantilevered spring part 275 projects outwardly from one side of the actuator part 274. Spring part 275 is of a generally bifurcated construction in that it includes two spring legs separated by a slot 267 therebetween. This spring part 275 projects sidewardly toward the intermediate rod part 265 whereby the bifurcated spring part straddles the intermediate rod part 265. This spring part 275 also angles downwardly so that the free end 276 thereof bearingly engages a top surface of the bearing 268, or alternatively the top wall 257.

The actuator member 273 also includes a U-shaped mounting part 278 which is joined generally to the other side of the actuator part 274 and projects upwardly for supportive engagement with the top rod part 269. This U-shaped mounting part 278 has aligned openings 279 formed in the opposed side legs 281–282 thereof, which openings enable the top rod part 269 to project therethrough so that the latter supports this U-shaped mounting part 278.

While the inner leg 281 of the U-shaped mounting part has the lower end thereof bent so as to be joined to the actuator part 274, the outer leg 282 is provided with an elongate platelike extension 283 which projects vertically downwardly through a vertical opening 284 formed in a plastic bearing member 285, which bearing member in turn is positioned within an opening formed through the top wall 257. The lower end of the platelike extension 283 has a hook 286 formed thereon, which hook resembles an inverted T. This hook engages the underside of the bearing 285 to limit upward lifting of the outer leg 282.

In operation, the actuator member 273 in effect functions as a resilient support member for the actuator rod 262, thereby maintaining the rod in a neutral or intermediate position substantially as illustrated by solid lines in FIG. 27, in which position the valve actuator 254 is in its raised and hence closed position. To activate the valve and hence open the air cylinder 251, normally the valve occupant will lift upwardly on the knob 264. This causes the actuator rod 262 to effectively pivot in a clockwise direction about the fulcrum 272 into the position illustrated by dotted lines in FIG. 30. During this pivoting, the top rod part 269 is pivoted downwardly causing downward depression of the valve actuator 254 which opens the valve and allows the air spring to be compressed or extended, depending upon whether the chair seat is loaded or unloaded. When the occupant releases the knob 264, the resiliency of the actuator part 274 swings the actuator rod back into its neutral or intermediate position, thereby allowing the valve actuator 254 to return upwardly into its closed position.

Depressing the valve actuator 254 so as to activate the lift cylinder 251 can also be effected by the operator pressing downwardly on the knob 264. When the operator presses the knob 264 downwardly, the entire actuator rod 262 pivots downwardly from its intermediate position into a lowermost position substantially as indicated by dash-dot lines in FIG. 30. This downward swinging occurs due to the fact that the hook 286 on the lower end of the outer leg 282 prevents the free end of the top rod part 269 from moving upwardly. Hence, the overall actuator 274 and the actuator rod 262 thus effectively fulcrum about the hook 286, whereby the top rod part 269 swings downwardly a limited extent about its free end, causing depression of the actuator part 274 and downward deflection of the spring part 275, and depression of the valve actuator 254. When the occupant manually releases the knob 264, the resiliency of the spring part 275 again returns the actuator rod 262 upwardly into its intermediate or neutral position, which permits the valve actuator 254 to raise upwardly into its closed position.

The lift control mechanism 261 of this invention enables activation of the pneumatic cylinder valve by pivoting the actuator rod 262 either upwardly or downwardly from a neutral or normal position. In addition, the overall mechanism 261 is of structural and operational simplicity and, in effect, employs only two main components, namely the actuator rod 262 and the actuator member 273. This actuator member 273 provides multiple functions in that it functions as a spring, it functions as an actuator or contact member for the valve actuator 254, it functions as a retainer for positionally coupling the actuator rod 262 thereto, and it additionally functions as a fulcrum when the mechanism is activated by downward displacement of the knob.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In an office-type chair having a base, a pedestal assembly projecting upwardly from said base, and a seat-back arrangement connected to an upper end of said pedestal assembly, said seat-back arrangement including a generally horizontally enlarged seat assembly and a back assembly projecting upwardly from and adjacent a rear edge of said seat assembly, said seat assembly including a control housing therein which is fixed to an upper end of the pedestal, said seat-back arrangement also including a rear tilt control mechanism for permitting at least the back assembly to be tilted rearwardly away from a normal upright position into a rearwardly tilted position, the tilt control mechanism including an upright which is at least partially positioned within said back assembly and is tiltable rearwardly relative to said control housing, said seat-back arrangement also including an inner shell connected to said upright and said control housing for supporting seat and back cushions, said shell being a semi-rigid but resiliently flexible sheet having a generally L-shaped elevational configuration which defines seat and back shell parts which respectively overlie the control housing and upright and which are integrally joined together by an arcuate shell part, comprising the improvement wherein said shell is connected to both said upright and said control housing solely by cooperating parts formed integrally with the shell, the control housing and the upright so as to fixedly connect the shell at least adjacent upper and front ends thereof to the respective upright and control housing, the shell being of a unitary construction such that the connection of said shell to said control housing and upright is free of separate or independent fasteners, said shell being fixed securely to said control housing solely adjacent a front portion of said control housing, said shell being fixed to said upright solely adjacent a top portion of said upright, said seat and back shell parts respectively having a rear portion disposed rearwardly of said front portion of said control housing and a lower portion disposed below said top portion of said upright, said rear portion and said lower portion together with said arcuate part being free of fixed securement to either said control housing or said upright.

2. A chair according to claim 1, wherein the cooperating parts include a first front pair of cooperating stop parts which are formed on and cooperate directly between a front portion of the seat shell part and the front portion of the control housing for preventing the seat shell part from moving forwardly relative to the control housing, and a second front pair of cooperating latch parts which also cooperate directly between said front portions for vertically securing the front portion of the seat shell part to the front portion of the control housing to prevent vertical movement therebetween, each of said first and second front pairs including a first part which is fixedly and integrally joined to the front portion of the seat shell part and a second part which is fixedly and integrally joined to the front portion of the control housing.

3. A chair according to claim 2, including a third front pair of flange parts engaging the front portion of said shell to the front portion of the control housing such that said shell is rotatable rearwardly to a secured position overlying the control housing, said cooperating latch parts being mutually secured together in response to said rearward rotation of said shell to said secured position.

4. A chair according to claim 2, wherein at least one of said first and second parts of the cooperating latch parts is resiliently deflectable so as to provide snap fitting securement of said shell to the control housing.

5. A chair according to claim 1, wherein the cooperating parts include a first top pair of cooperating stop parts which are formed on and cooperate directly between a top portion of the back shell part and the top portion of the upright for preventing the back shell part from moving upwardly relative to the upright, and a second top pair of cooperating latch parts which also cooperate directly between said top portions for horizontally securing the top portion of the back shell part to the top portion of the upright to prevent horizontal movement therebetween, each of said first and second top pairs including a first part which is fixedly and integrally joined to the top portion of the back shell part and a second part which is fixedly and integrally joined to the top portion of the upright.

6. A chair according to claim 5, wherein the cooperating parts include a first front pair of cooperating stop parts which are formed on and cooperate directly between a front portion of the seat shell part and the front portion of the control housing for preventing the seat shell part from moving forwardly relative to the control housing, and a second front pair of cooperating latch parts which also cooperate directly between said front portions for vertically securing the front portion of the seat shell part to the front portion of the control housing to prevent vertical movement therebetween, each of said first and second front pairs including a first part which is fixedly and integrally joined to the front portion of the seat shell part and a-second part which is fixedly and integrally joined to the front portion of the control housing.

7. A chair according to claim 5, wherein said first and second pairs of the cooperating parts permit sliding movement of said shell along a frontward facing surface of said upright to a secured position, said stop parts being mutually secured together in response to positioning of said shell in said secured position.

8. A chair according to claim 1, wherein a first front pair and a second front pair of cooperating parts are formed on and cooperate directly between a front portion of the seat shell part and the front portion of the control housing, each of the first and second front pairs of cooperating parts including a first part integrally formed on the front portion of the seat shell and a corresponding second part integrally formed on a front portion of the control housing, one of said first parts on said control housing defining a rearward facing surface disposed in an opposing relation with a forward facing surface of the corresponding second part and the other of said first parts defining a forward facing surface disposed in an opposing relation with an opposing rearward facing surface of the corresponding second part to respectively limit forward and rearward movement of the seat shell part relative to the control housing.

9. A chair according to claim 8, wherein one of said first and second parts is a stop block which is substantially non-deflectable to prevent forward displacement of said shell relative to said control housing.

10. A chair according to claim 8, wherein one of said first and second parts is a resiliently flexible projection which snap lockingly secures said shell to said control housing.

11. In an office-type chair having a base, a pedestal assembly projecting upwardly from said base, and a seat-back arrangement connected to an upper end of said pedestal assembly, said seat-back arrangement including a generally horizontally enlarged seat assembly and a back assembly projecting upwardly from and adjacent a rear edge of said seat assembly, said seat assembly including a housing which is fixed to an upper end of the pedestal, said seat-back arrangement also including a rear tilt control mechanism for permitting at least the back assembly to be tilted rearwardly away from a normal upright position into a rearwardly tilted position, the tilt control mechanism including an upright member which is connected to said back assembly and is generally tiltable rearwardly relative to said housing, said seat-back arrangement also including an inner shell connected to said upright and said housing for supporting seat and back cushions, said shell being a semi-rigid but resiliently flexible sheet having a generally L-shaped elevational configuration which defines seat and back shell parts which respectively overlie the housing and upright and which are integrally joined together by an arcuate shell part, comprising the improvement wherein said shell is connected to both said upright and said housing solely by cooperating parts formed integrally with the shell, the housing and the upright so as to fixedly connect the shell at least adjacent upper and front ends thereof to the respective upright and housing, said shell being fixed to said housing solely adjacent the front portion thereof, said shell being fixed to said upright solely adjacent the upper portion thereof, said seat and back shell parts respectively having rear and lower portions thereof which together with said arcuate part are free of fixed securement to either said housing or said upright, the rear portion of said seat shell part being flexible downwardly relative to the front portion thereof in response to rearward tilting of the back assembly.

12. A chair according to claim 11, wherein the cooperating parts include a first front pair of cooperating stop parts which are formed on and cooperate directly between a front portion of the seat shell part and a front portion of the housing for preventing the seat shell part from moving forwardly relative to the housing, and a second front pair of cooperating latch parts which also cooperate directly between said front portions for vertically securing the front portion of the seat shell part to the front portion of the housing to prevent vertical movement therebetween, each of said first and second pairs including a first part which is fixedly and integrally joined to the front portion of the seat shell part and a second part which is fixedly and integrally joined to a front portion of the housing.

13. A chair according to claim 11, wherein said upright includes a lower portion having an upwardly facing support surface thereon which is disposed within a rear portion of said seat assembly, said seat shell part being positioned over said support surface and having a bearing part integrally fixed thereon and projecting downwardly for slidable engagement with said support surface.

14. A chair according to claim 11, wherein the cooperating parts includes a first top pair of cooperating stop parts which are formed on and cooperate directly between a top portion of the back shell part and a top portion of the upright for preventing the back shell part from moving upwardly relative to the upright, and a second top pair of cooperating latch parts which also cooperate directly between said top portions for horizontally securing the top portion of the back shell part to the top portion of the upright to prevent horizontal movement therebetween, each of said first and second top pairs including a first part which is fixedly and integrally joined to the top portion of the back shell part and a second part which is fixedly and integrally joined to a top portion of the upright.

15. A chair according to claim 14, wherein the cooperating parts include a first front pair of cooperating stop parts which are formed on and cooperate directly between a front portion of the seat shell part and a front portion of the housing for preventing the seat shell part from moving forwardly relative to the housing, and a second front pair of cooperating latch parts which also cooperate directly between said front portions for vertically securing the front portion of the seat shell part to the front portion of the housing to prevent vertical movement therebetween, each of said first and second front pairs including a first part which is fixedly and integrally joined to the front portion of the seat shell part and a second part which is fixedly and integrally joined to a front portion of the housing.

16. A chair comprising:

a base;

a pedestal assembly projecting upwardly from said base;

a seat-back arrangement which is connected to an upper pedestal portion of said pedestal assembly and includes a fixed body that is fixed to the upper pedestal portion and an upright pivotally connected to a rear portion of the fixed body so as to be tiltable relative to the fixed body in a direction rearwardly away from a normal upright position into a rearwardly tilted position, the seat-back arrangement further including an inner shell connected to said upright and said fixed body for supporting seat and back cushions, said shell being a semi-rigid but resiliently flexible one-piece plastic sheet having a generally L-shaped elevational configuration which defines seat and back shell parts which respectively overlie the fixed body and upright and which are integrally joined together by an arcuate shell part;

said shell being connected to both said upright and said fixed body solely by cooperating parts formed integrally with the shell, the fixed body and the upright so as to fixedly connect the shell at least adjacent upper and front portions thereof to the respective upright and fixed body;

said fixed body including a front body portion spaced a substantial distance forwardly of said upper pedestal portion, the front portion of said seat shell part being fixedly secured to said front body portion such that a rear portion of the shell that is disposed rearwardly of said front body portion resiliently flexes in response to said rearward tilting of said upright, said rear portion of the seat shell part being enlarged rearwardly relative to said front portion and being flexibly joined to said front portion by a flexing hinge portion extending widthwise of said seat shell part so as to facilitate deflection of the rear portion relative to the front portion, said shell being fixed securely to said fixed body solely adjacent the front body portion of said fixed body, said shell being fixed to said upright solely adjacent an upper portion of said upright, said seat and back shell parts respectively having said rear portion and a lower portion thereof which together with said arcuate part are free of fixed securement to either said fixed body or said upright.

17. A chair according to claim 16, wherein said hinge portion has a reduced thickness relative to said front and rear portions so as to facilitate flexing.

18. A chair according to claim 17, wherein seat shell part includes rearwardly extending ribs integrally formed on the seat shell part which are notched in the region of the hinge portion to define the reduced thickness thereof.

19. A chair according to claim 18, wherein said upright includes a lower portion having an upwardly facing support surface thereon which is disposed within a rear portion of said seat-back arrangement, said seat shell part being positioned over said support surface and having a bearing part integrally fixed thereon and projecting downwardly in slidable engagement with said support surface.

20. A chair according to claim 16, wherein said hinge part is disposed forwardly a substantial distance from said upper pedestal portion.

21. A chair comprising:

a base;

a pedestal assembly projecting upwardly from said base;

a seat-back arrangement which is connected to an upper pedestal portion of said pedestal assembly and includes a fixed body that is fixed to the upper pedestal portion and an upright pivotally connected to a rear portion of the fixed body so as to be tiltable relative to the fixed body in a direction rearwardly away from a normal upright position into a rearwardly tilted position, the seat-back arrangement further including an inner shell connected to said upright and said fixed body for supporting seat and back cushions, said shell being a semi-rigid but resiliently flexible one-piece sheet having a generally L-shaped elevational configuration which defines seat and back shell parts which respectively overlie the fixed body and upright and which are integrally joined together by an arcuate shell part;

said shell being connected to both said upright and said fixed body solely by connection means for fixedly connecting the shell at least adjacent upper and front ends thereof to the respective upright and fixed body, said connection means comprising cooperating parts which are formed integrally with the shell, the fixed body and the upright and which define front and upper connections between said shell and said fixed body and upright respectively that are free of separate or independent fasteners, at least one of said front and upper connections being a snap fit connection, said shell being fixed to said housing solely adjacent the front portion thereof, and said shell being fixed to said upright solely adjacent the upper portion thereof, said seat and back shell parts respectively having rear and lower portions thereof which together with said arcuate part are free of fixed securement to either said housing or said upright, the rear portion of said seat shell part being flexible downwardly relative to the front portion thereof in response to rearward tilting of the back assembly.

22. A chair according to claim 21, wherein said cooperating parts includes a first front pair of cooperating latch parts for preventing vertical movement of the front portion of the shell relative to the front portion of the fixed body, said first front pair comprising a first part on one of said fixed body and said seat shell part and a second part on the other of said fixed body and said seat shell part, said first part being a resiliently flexible projection which is snap lockably engageable with said second part on said fixed body.

23. A chair according to claim 22, wherein said cooperating parts includes a second pair of cooperating flange parts closely proximate a front edge of said fixed body which prevent rearward movement of said shell relative to said fixed body.

24. A chair according to claim 23, wherein said cooperating flange parts define a rotation axis closely proximate a front edge of said fixed body about which said shell is rearwardly rotatable into a secured position overlying said fixed body, said first part of the latch parts being snap lockable with said second part in response to rotation of said shell into said secured position.

25. A chair according to claim 22, wherein said cooperating parts include a top plurality of cooperating latch parts which cooperate directly between said top portions in snap fit engagement for horizontally securing the top portion of the back shell part to the top portion of the upright to prevent horizontal movement therebetween.

26. A chair according to claim 21, wherein the cooperating parts include a first top pair of cooperating stop parts which are formed on and cooperate directly between a top portion of the back shell part and a top portion of the upright for preventing the back shell part from moving upwardly relative to the upright, said first top pair including a first part which is fixedly and integrally formed with the top portion of the back shell part and a second part which is integrally formed with a top portion of the upright, said first and second parts of said first top pair being resiliently snap lockable into engagement one with the other in response to movement of the shell relative to the upright.

27. A chair according to claim 21, wherein the cooperating parts include a first top pair of cooperating stop parts which are formed on and cooperate directly between a top portion of the back shell part and a top portion of the upright for preventing the back shell part from moving upwardly relative to the upright, and a second top pair of cooperating latch parts which also cooperate directly between said top portions for horizontally securing the top portion of the back shell part to the top portion of the upright to prevent horizontal movement therebetween, each of said first and second top pairs including a first part which is fixedly and integrally joined to the top portion of the back shell part and a second part which is fixedly and integrally joined to a top portion of the upright.

28. A chair comprising:

a base;

a pedestal assembly projecting upwardly from said base;

a seat-back arrangement which is connected to an upper pedestal portion of said pedestal assembly and includes a fixed body that is fixed to the upper pedestal portion and an upright pivotally connected to a rear portion of the fixed body so as to be tiltable relative to the fixed body in a direction rearwardly away from a normal upright position into a rearwardly tilted position, the seat-back arrangement further including an inner shell connected to said upright and said fixed body for supporting seat and back cushions, said shell being a semi-rigid but resiliently flexible sheet having a generally L-shaped elevational configuration which defines seat and back shell parts which respectively overlie the fixed body and upright and which are integrally joined together by an arcuate shell part;

said shell being connected to both said upright and said fixed body solely by cooperating parts formed integrally with the shell, the fixed body and the upright so as to fixedly connect the shell at least adjacent upper and front ends thereof to the respective upright and fixed body, said upper end of said shell and said upright having first said cooperating parts disposed thereon such that said upper end fixedly connects to said upright upon relative movement of said upper end relative to a frontward facing surface of said upright to a secured position in engagement with said upright, said front end of said shell and said fixed body having second said cooperating parts disposed thereon such that said front end fixedly connects to said fixed body upon relative movement of said shell to a generally horizontal secured position in engagement with said fixed body, said second cooperating parts including cooperating flange parts which pivotally connect said shell and a front portion of said fixed body together and permits rearward rotating of said seat shell part to said secured position overlying said fixed body, and cooperating front snap connector parts which snap fittingly engage said shell with said fixed body when said seat shell part is in said secured position.

29. A chair according to claim 28, wherein said movement of said shell relative to said upright is in a downward direction along said frontward facing surface to said secured position, said first cooperating parts include upper snap connector parts which snap fittingly engage said shell with said fixed body in response to downward movement of said shell to said secured position.

30. A chair according to claim 29, wherein the first cooperating parts includes a first top pair of cooperating parts which are formed on and cooperate directly between a top portion of the back shell part and a top portion of the upright when the back shell part is disposed in the secured position for preventing the back shell part from moving upwardly relative to the upright, and a second top pair of cooperating parts which also cooperate directly between said top portions for horizontally securing the top portion of the back shell part to the top portion of the upright to prevent horizontal movement therebetween when the back shell part is disposed in the secured position, each of said first and second top pairs including a first part which is fixedly joined to the top portion of the back shell part and a second part which is fixedly joined to a top portion of the upright.

31. A chair according to claim 28, wherein said shell is fixed to said fixed body solely adjacent the front portion thereof, said shell being fixed to said upright solely adjacent the upper portion thereof, said seat and back shell parts respectively having rear and lower portions thereof which together with said arcuate part are free of fixed securement to either said fixed body or said upright, the rear portion of said seat shell part being flexible downwardly relative to the front portion thereof in response to rearward tilting of the back assembly.

32. A chair according to claim 28, wherein a first top pair and a second top pair of cooperating parts are formed on and cooperate directly between a top portion of the back shell part and a top portion of the upright, each of the first and second top pairs of cooperating parts including a first part integrally formed on the top portion of the back shell part and a corresponding second part integrally formed on a top portion of the upright, one of said first parts on said upright defining an upward facing surface disposed in an opposing relation with a downward facing surface of the corresponding second part and the other of said first parts defining a downward facing surface disposed in an opposing relation with an opposing upward facing surface of the corresponding second part to respectively prevent upward and downward movement of the back shell part relative to the upright.

33. A chair according to claim 28, wherein said connection of said shell to said fixed body and upright is free of separate or independent fasteners.

* * * * *